US006806043B2

(12) United States Patent
Takizawa

(10) Patent No.: US 6,806,043 B2
(45) Date of Patent: Oct. 19, 2004

(54) METHINE DYE AND SILVER HALIDE PHOTOGRAPHIC LIGHT-SENSITIVE MATERIAL CONTAINING THE SAME

(75) Inventor: Hiroo Takizawa, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 41 days.

(21) Appl. No.: 10/103,005

(22) Filed: Mar. 22, 2002

(65) Prior Publication Data

US 2003/0138746 A1 Jul. 24, 2003

(30) Foreign Application Priority Data

Mar. 23, 2001 (JP) ..... P.2001-085131

(51) Int. Cl.[7] ..... G03C 1/005; G03C 1/494

(52) U.S. Cl. ..... 430/581; 430/570; 430/574; 430/576; 430/583; 430/584; 430/588

(58) Field of Search ..... 430/570, 574, 430/576, 581, 583, 584, 588

(56) References Cited

U.S. PATENT DOCUMENTS 6,165,703 A * 12/2000 Parton et al. ..... 430/572
6,582,894 B1 * 6/2003 Hioki et al. ..... 430/572
6,632,597 B2 * 10/2003 Takizawa ..... 430/574
2002/0086250 A1 * 7/2002 Katoh et al. ..... 430/574
2002/0155400 A1 * 10/2002 Takizawa ..... 430/574

FOREIGN PATENT DOCUMENTS

EP 0 887 700 A1 12/1998

* cited by examiner

*Primary Examiner*—Geraldine Letscher
(74) *Attorney, Agent, or Firm*—Sughrue Mion, PLLC

(57) ABSTRACT

A silver halide photographic light-sensitive material is disclosed, comprising a support having thereon at least one light-sensitive silver halide emulsion layer, wherein said emulsion layer contains a compound represented by the following formula (1):

$$\text{Dye1-(L}_1\text{-(Dye2)m1)m2} \quad (1)$$

wherein Dye1 represents a cyanine chromophore, Dye2 represents a merocyanine dye having in the acid nucleus thereof at least one dissociative group having a pKa of 5 or less, and $L_1$ represents a linking group represented by $-G_1-(A_1-G_2)_{t1}-$(wherein $G_1$ and $G_2$ each independently represents an alkylene, alkenylene or arylene group which may be substituted, $A_1$ represents, irrespective of the direction, —O—, —S—, —$SO_2$—, —$NR_3$—, —COO—, —$CONR_4$— or —$SO_2NR_5$— (wherein $R_3$ to $R_5$ each independently represents a hydrogen atom, an alkyl group, an alkenyl group, an aryl group or a heterocyclic group) and t1 represents an integer of 1 to 10), m1 represents an integer of 1 to 5, and m2 represents an integer of 1 to 5.

16 Claims, No Drawings

METHINE DYE AND SILVER HALIDE PHOTOGRAPHIC LIGHT-SENSITIVE MATERIAL CONTAINING THE SAME

FIELD OF THE INVENTION

The present invention relates to a novel methine dye compound, more specifically, the present invention relates to a connection-type methine dye compound where two chromophores are connected and also relates to a silver halide photographic light-sensitive material containing the compound.

BACKGROUND OF THE INVENTION

Methine compounds have been conventionally used as a spectral sensitizing dye for silver halide photographic light-sensitive materials. With respect to the technology for improving the light absorptivity of silver halide grain, the following techniques are known. In order to improve the light absorptivity per one grain, the adsorption density of the sensitizing dye to a silver halide grain must be increased, however, a normal spectral sensitizing dye adsorbs to a monomolecular layer almost in the highest density filling state and does not adsorb any more.

For the purpose of solving this problem, several proposals have been heretofore made. P. B. Gilman, Jr. et al., *Photographic Science and Engineering*, Vol. 20, No. 3, page 97 (1976) describes a technique of allowing a cationic dye to adsorb to the first layer and an anionic dye to adsorb to the second layer using electrostatic force. U.S. Pat. No. 3,622,316 (G. B. Bird et al.) describes a technique of allowing a plurality of dyes to adsorb to a silver halide grain to form multiple layers and attaining the sensitization by virtue of Forster type excited energy transfer.

JP-A-63-138341 (the term "JP-A" as used herein means an "unexamined published Japanese patent application") and JP-A-64-84244 (both Sugimoto et al.) describe a technique of performing the spectral sensitization using the energy transfer from a light-emitting dye.

These techniques have been proposed with an attempt to allow a dye to adsorb to a silver halide grain in excess of the saturated adsorption amount, however, the effect of elevating the sensitivity is not so high and there is a problem such as increase in the intrinsic desensitization.

On the other hand, U.S. Pat. Nos. 2,393,351, 2,425,772, 2,518,732, 2,521,944 and 2,592,196 and European Patent 565,083 describe a 2 components-connected dye in which two or more non-conjugated dye chromophores are connected through a covalent bond. This technique is, however, not intended to improve the light absorptivity. As for the technique of aggressively improving the light absorptivity, U.S. Pat. Nos. 3,622,317 and 3,976,493 (both G. B. Bird et al.) describe a connection-type sensitizing dye molecule having a plurality of cyanine chromophores, which is adsorbed to a grain to increase the light absorptivity with an attempt to attain sensitization by the energy transfer, where, however, remarkable elevation of the sensitivity is not obtained.

JP-A-64-91134 (Ukai et al.) proposes a technique of connecting a substantially non-adsorptive dye containing at least two sulfo or carboxy groups to at least one spectral sensitizing dye capable of adsorbing onto silver halide.

Also, in the spectral sensitization, JP-A-6-27578 (Vishwakarma et al.) uses a 2 components-connected dye in which a cyanine dye adsorptive to silver halide and an oxonol not adsorptive to silver halide are connected, or European Patent 887700A1 (Parton et al.) uses a 2 components-connected dye in which an adsorptive cyanine dye and a nonadsorptive merocyanine dye or the like are connected using a specific linking group. In these techniques, however, the sensitivity is not sufficiently elevated by the energy transfer.

Furthermore, JP-A-6-57235 (Vishwakarma et al.) discloses a production method of a 2 components-connected dye in which a cyanine dye and a merocyanine dye are connected, however, there is no Example revealing that high elevation of the sensitivity is attained by the use of this dye as a sensitizing dye for silver halide photographic light-sensitive materials.

As such, sufficiently high elevation of the sensitivity is not yet achieved in any of these patents or publications and more development of techniques is being demanded.

SUMMARY OF THE INVENTION

Accordingly, one object of the present invention is to provide a novel methine-connected dye.

Another object of the present invention is to provide a high-sensitivity silver halide photographic light-sensitive material comprising the dye.

These objects of the present invention can be attained by the following means.

(1) A silver halide photographic light-sensitive material comprising a support having thereon at least one light-sensitive silver halide emulsion layer, wherein the emulsion layer contains a compound represented by the following formula (1):

$$\text{Dye1-}(L_1\text{-}(\text{Dye2})_{m1})_{m2} \qquad (1)$$

wherein Dye1 represents a cyanine chromophore, Dye2 represents a merocyanine dye having in the acid nucleus thereof at least one dissociative group having a pKa of 5 or less, and $L_1$ represents a linking group, m1 represents an integer of 1 to 5, and m2 represents an integer of 1 to 5.

(2) The silver halide photographic light-sensitive material as described in (1), wherein in the compound represented by formula (1), Dye1 is a cyanine chromophore, a merocyanine dye or an oxonol chromophore.

(3) The silver halide photographic light-sensitive material as described in (1) or (2), wherein in the compound represented by formula (1), Dye1 is a cyanine chromophore.

(4) The silver halide photographic light-sensitive material as described in any one of (1) to (3), wherein in the compound represented by formula (1), $L_1$ is represented by $-G_1-(A_1-G_2-)_{t1}-$(wherein $G_1$ and $G_2$ each independently represents an alkylene, alkenylene or arylene group which may be substituted, $A_1$ represents, irrespective of the direction, —O—, —S—, —$SO_2$—, —$NR_3$—, —COO—, —$CONR_4$— or —$SO_2NR_5$— (wherein $R_3$ to $R_5$ each independently represents a hydrogen atom, an alkyl group, an alkenyl group, an aryl group or a heterocyclic group) and t1 represents an integer of 1 to 10).

(5) The silver halide photographic light-sensitive material as described in (1) to (4), wherein in the compound represented by formula (1), the linking group $L_1$ is connected to the acidic nucleus of the merocyanine dye Dye2.

(6) The silver halide photographic light-sensitive material as described in any one of (1) to (5), wherein the compound represented by formula (1) is represented by the following formula (2):

(Dye2)

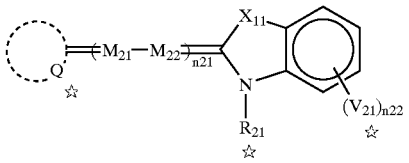

(2)

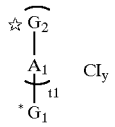

(Dye1)

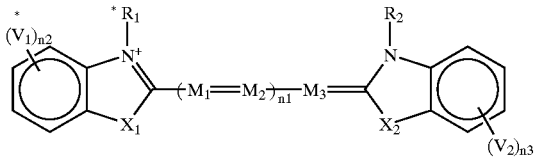

wherein $G_1$, $G_2$, $A_1$ and t1 have the same meanings as defined in (4); $X_1$, $X_2$ and $X_{11}$ each independently represents —O—, —S—, —$NR_6$ or —$CR_7R_8$—; $R_6$ to $R_8$ each independently represents a hydrogen atom, an alkyl group, an alkenyl group, an aryl group or a heterocyclic group; $R_1$, $R_2$ and $R_{21}$ each independently represents a hydrogen atom, an alkyl group, an alkenyl group, an aryl group or a heterocyclic group; $M_1$ to $M_3$, $M_{21}$ and $M_{22}$ each independently represents a methine group; n1 and n21 each independently represents an integer of 0 to 3; $V_1$, $V_2$ and $V_{21}$ each represents a substituent; n2, n3 and n22 each represents an integer of 0 to 4, provided that when n2, n3 and n22 each is 2 or more, the substituents $V_1$, the substituents $V_2$ or the substituents $V_{21}$ may be the same or different or may be combined with each other to form a ring; CI represents an ion for neutralizing the electric charge; y represents a number necessary for neutralizing the electric charge; the ring formed by Q is represented by the following formula (3-1), (3-2), (3-3) or (3-4):

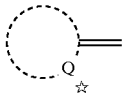

(3-1)

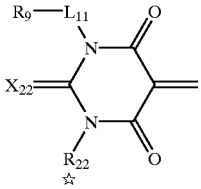

(3-2)

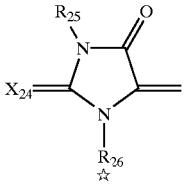

-continued (3-3)

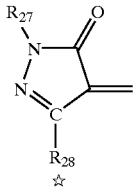

(3-4)

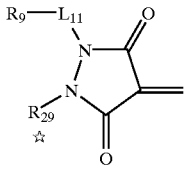

wherein $R_{22}$ and $R_{29}$ each independently represents a hydrogen atom, an alkyl group, an alkenyl group, an aryl group or a heterocyclic group, $R_{25}$ to $R_{27}$ each independently represents a hydrogen atom, an alkyl group, an alkenyl group, an aryl group, a heterocyclic group or $R_9$-$L_{11}$-, $R_{28}$ represents a substituent, a hydrogen atom or $R_9$-$L_{11}$-(wherein $R_9$ represents a dissociative group having a pKa of 5 or less, and $L_{11}$ represents a linking group), provided that either one of $R_{25}$ and $R_{26}$ is $R_9$-$L_{11}$- and either one of $R_{27}$ and $R_{28}$ is $R_9$-$L_{11}$-, and $X_{22}$ and $X_{24}$ each independently represents an oxygen atom or a sulfur atom; and $G_1$ is connected to Dye1 through $R_1$ or $V_1$ and $G_2$ is connected to Dye2 through $R_{21}$, $R_{22}$, $R_{25}$, $R_{26}$, $R_{27}$, $R_{28}$, $R_{29}$ or $V_{21}$.

(7) The silver halide photographic light-sensitive material as described in (5) or (6), wherein in the compound represented by formula (1) or (2), $G_1$ and $G_2$ each is an alkylene group.

(8) The silver halide photographic light-sensitive material as described in any one of (5) to (7), wherein in the compound represented by formula (1) or (2), $A_1$ is —O—, —$SO_2$—, —COO— or —$CONR_4$—.

(9) The silver halide photographic light-sensitive material as described in any one of (6) to (8), wherein in the compound represented by formula (2), $X_1$ and $X_2$ each is —O— or —S—.

(10) The silver halide photographic light-sensitive material as described in any one of (6) to (9), wherein in the compound represented by formula (2), n1 is 0 or 1.

(11) The silver halide photographic light-sensitive material as described in any one of (6) to (10), wherein in the compound represented by formula (2), n21 is 0, 1 or 2.

(12) The silver halide photographic light-sensitive material as described in any one of (6) to (11), wherein in the compound represented by formula (2), n1 is 0, $X_1$ and $X_2$ each is —S—, and n21 is 1.

(13) The silver halide photographic light-sensitive material as described in any one of (6) to (11), wherein in the compound represented by formula (2), n1 is 1, $X_1$ and $X_2$ each is —O—, and n21 is 2.

(14) The silver halide photographic light-sensitive material as described in any one of (6) to (13), wherein in the compound represented by formula (2), $X_{21}$ is —O—.

(15) The silver halide photographic light-sensitive material as described in any one of (1) to (14), wherein the dissociative group in the compound represented by formula (1) or $R_9$ in the compound represented by formula (2) is —$SO_3M$, —$OSO_3M_2$, —$PO_3M_2$, —$OPO_3M_2$ or —COOM, and M is proton or cation.

(16) The silver halide photographic light-sensitive material as described in (15), wherein the dissociative group in the compound represented by formula (1) or $R_9$ in the compound represented by formula (2) is —$SO_3M$.

(17) The silver halide photographic light-sensitive material as described in any one of (6) to (16), wherein in the compound represented by formula (2), $L_{11}$ is an alkylene group which may be substituted or a phenylene group which may be substituted.

(18) The silver halide photographic light-sensitive material as described in (17), wherein in the compound represented by formula (2), $L_{11}$ is an ethylene group.

(19) The silver halide photographic light-sensitive material as described in (17), wherein in the compound represented by formula (2), $L_{11}$ is a phenylene group which may be substituted.

(20) The silver halide photographic light-sensitive material as described in (17), wherein in the compound represented by formula (2), $L_{11}$ is a 1,2-phenylene group which may be substituted.

(21) The silver halide photographic light-sensitive material as described in any one of (6) to (20), wherein in the compound represented by formula (2), $G_1$ is connected with $R_1$ and $G_2$ is connected with $R_{22}$, $R_{25}$, $R_{26}$, $R_{27}$, $R_{28}$ or $R_{29}$.

(22) The silver halide photographic light-sensitive material as described in any one of (6) to (21), wherein in the compound represented by formula (2), Q is represented by formula (3-1).

(23) The silver halide photographic light-sensitive material as described in (22), wherein in the compound represented by formula (2), Q is represented by formula (3-1) and $X_{22}$ is an oxygen atom.

(24) The silver halide photographic light-sensitive material as described in any one of (1) to (23), wherein in the compound represented by formula (1) or (2), the adsorption strength to silver halide grain is Dye1>Dye2.

(25) The silver halide photographic light-sensitive material as described in any one of (1) to (24), wherein the compound represented by formula (1) or (2) adsorbs to a silver halide grain through Dye1 and when Dye2 not adsorbed to a silver halide grain is excited by light, electron transfer or energy transfer to Dye1 takes place.

(26) The silver halide photographic light-sensitive material as described in any one of (1) to (25), wherein the compound represented by formula (1) or (2) adsorbs to a silver halide grain through Dye1 and forms a J-aggregate.

(27) The silver halide photographic light-sensitive material as described in any one of (1) to (26), wherein the silver halide photographic emulsion containing the compound represented by formula (1) or (2) is an emulsion in which tabular grains having an aspect ratio of 2 or more are present in a proportion of 50% (by area) or more of all silver halide grains in the emulsion.

(28) The silver halide photographic light-sensitive material as described in any one of (1) to (27), wherein the silver halide photographic emulsion containing the compound represented by formula (1) or (2) is subjected to selenium sensitization.

(29) A dye represented by formula (2) described in (6) or (15).

(30) The dye represented by formula (2) as described in (29), wherein $L_{11}$ is a 1,2-phenylene group which may be substituted.

DETAILED DESCRIPTION OF THE INVENTION

The compound represented by formula (1) of the present invention is described in detail below.

When the compound of the present invention has an alkyl group, an alkylene group, an alkenyl group or an alkenylene group, unless otherwise indicated, these groups each may be linear or branched or may be substituted or unsubstituted.

When the compound of the present invention has a cycloalkyl group, an aryl group, a heterocyclic group, a cycloalkenylene group, an arylene group or a heterylene group, unless otherwise indicated, these groups each may be a monocyclic ring or a condensed ring or may be substituted or unsubstituted.

In the present invention, when a specific site is called "a group", the site itself may not be substituted or may be substituted by one or more (to a possible maximum number) substituents.

For example, "an alkyl group" means a substituted or unsubstituted alkyl group. Furthermore, the substituents which can be used in the compound for use in the present invention include, irrespective of the presence or absence of substitution, any substituent. For example, the following substituents W may be used.

The substituent represented by W may be any substituent and is not particularly limited, however, examples thereof include a halogen atom, an alkyl group [including cycloalkyl group, bicycloalkyl group and tricycloalkyl group, and also including an alkenyl group (including cycloalkenyl group and bicycloalkenyl group) and an alkynyl group], an aryl group, a heterocyclic group, a cyano group, a hydroxyl group, a nitro group, a carboxyl group, an alkoxy group, an aryloxy group, a silyloxy group, a heterocyclic oxy group, an acyloxy group, a carbamoyloxy group, an alkoxycarbonyloxy group, an aryloxycarbonyloxy group, an amino group (including an anilino group), an ammonio group, an acylamino group, an aminocarbonylamino group, an alkoxycarbonylamino group, an aryloxycarbonylamino group, a sulfamoylamino group, an alkylsulfonylamino group, an arylsulfonylamino group, a mercapto group, an alkylthio group, an arylthio group, a heterocyclic thio group, a sulfamoyl group, a sulfo group, an alkylsulfinyl group, an arylsulfinyl group, an alkylsulfonyl group, an arylsulfonyl group, an acyl group, an aryloxycarbonyl group, an alkoxycarbonyl group, a carbamoyl group, an arylazo group, a heterocyclic azo group, an imido group, a phosphino group, a phophinyl group, a phosphinyloxy group, a phosphinylamino group, a phospho group, a silyl group, a hydrazino group, a ureido group and other known substituents.

More specifically, W represents a halogen atom (e.g., fluorine, chlorine, bromine, iodine), an alkyl group [which means a linear, branched or cyclic, or substituted or unsubstituted alkyl group and which includes an alkyl group (preferably an alkyl group having from 1 to 30 carbon atoms, e.g., methyl, ethyl, n-propyl, isopropyl, tert-butyl, n-octyl, eicosyl, 2-chloroethyl, 2-cyanoethyl, 2-ethylhexyl), a cycloalkyl group (preferably a substituted or unsubstituted cycloalkyl group having from 3 to 30 carbon atoms, e.g., cyclohexyl, cyclopentyl, 4-n-dodecylcyclohexyl), a bicycloalkyl group (preferably a substituted or unsubstituted bicycloalkyl group having from 5 to 30 carbon atoms, namely, a monovalent group resultant from removing one hydrogen atom of a bicycloalkane having from 5 to 30 carbon atoms, e.g., bicyclo[1,2,2]heptan-2-yl, bicyclo[2,2,2]octan-3-yl), and a tricyclo-structure having many cyclic structures; the alkyl group in the substituents described below (for example, an alkyl group in an alkylthio group) means an alkyl group having such a concept but also includes an alkenyl group and an alkynyl group], an alkenyl group [which means a linear, branched or cyclic, substituted or unsubstituted alkenyl group and which includes an alkenyl group (preferably a substituted or unsubstituted alkenyl group having from 2 to 30 carbon atoms, e.g., vinyl, allyl prenyl, geranyl, oreyl), a cycloalkenyl group (preferably a substituted or unsubstituted cycloalkenyl group having from 3 to 30 carbon atoms, namely, a monovalent group resultant from removing one hydrogen atom of a cycloalkane having from 3 to 30 carbon atoms, e.g., 2-cyclopenten-1-yl, 2-cyclohexen-1-yl), and a bicycloalkenyl group (a substituted or unsubstituted bicycloalkenyl group, preferably a substituted or unsubstituted bicycloalkenyl group having from 5 to 30 carbon atoms, namely, a monovalent group resultant from removing one hydrogen atom of a bicycloalkane having one double bond, e.g., bicyclo[2,2,1]hept-2-en-1-yl, bicyclo[2,2,2]oct-2-en-4-yl)], an alkynyl group (preferably a substituted or unsubstituted alkynyl group having from 2 to 30 carbon atoms, e.g., ethynyl, propargyl, trimethylsilylethynyl), an aryl group (preferably a substituted or unsubstituted aryl group having from 6 to 30 carbon atoms, e.g., phenyl, p-tolyl, naphthyl, m-chlorophenyl, o-hexadecanoylaminophenyl), a heterocyclic group (preferably a monovalent group resultant from removing one hydrogen atom of a 5- or 6-membered substituted or unsubstituted, aromatic or non-aromatic heterocyclic compound, more preferably a 5- or 6-membered aromatic heterocyclic group having from 3 to 30 carbon atoms, e.g., 2-furyl, 2-thienyl, 2-pyrimidinyl, 2-benzothiazolyl; the heterocyclic group may also be a cationic heterocyclic group such as 1-methyl-2-pyridinio and 1-methyl-2-quinolinio), a cyano group, a hydroxyl group, a nitro group, a carboxyl group, an alkoxy group (preferably a substituted or unsubstituted alkoxy group having from 1 to 30 carbon atoms, e.g., methoxy, ethoxy, isopropoxy, tert-butoxy, n-octyloxy, 2-methoxyethoxy), an aryloxy group (preferably a substituted or unsubstituted aryloxy group having from 6 to 30 carbon atoms, e.g., phenoxy, 2-methylphenoxy, 4-tert-butylphenoxy, 3-nitrophenoxy, 2-tetradecanoylaminophenoxy), a silyloxy group (preferably a silyloxy group having from 3 to 20 carbon atoms, e.g. trimethylsilyloxy, tert-butyldimethylsilyloxy), a heterocyclic oxy group (preferably a substituted or unsubstituted heterocyclic oxy group having from 2 to 30 carbon atoms, e.g., 1-phenyltetrazol-5-oxy, 2-tetrahydropyranyloxy), an acyloxy group (preferably a formyloxy group, a substituted or unsubstituted alkylcarbonyloxy group having from 2 to 30 carbon atoms or a substituted or unsubstituted arylcarbonyloxy group having from 6 to 30 carbon atoms, e.g., formyloxy, acetyloxy, pivaloyloxy, stearoyloxy, benzoyloxy, p-methoxyphenylcarbonyloxy), a carbamoyloxy group (preferably a substituted or unsubstituted carbamoyloxy group having from 1 to 30 carbon atoms, e.g., N,N-dimethylcarbamoyloxy, N,N-diethylcarbamoyloxy, morpholinocarbonyloxy, N,N-di-n-octylaminocarbonyloxy, N-n-octylcarbamoyloxy), an alkoxycarbonyloxy group (preferably a substituted or unsubstituted alkoxycarbonyloxy group having from 2 to 30 carbon atoms, e.g., methoxycarbonyloxy, ethoxycarbonyloxy, tert-butoxycarbonyloxy, n-octylcarbonyloxy), an aryloxycarbonyloxy group (preferably a substituted or unsubstituted aryloxycarbonyloxy group having from 7 to 30 carbon atoms, e.g., phenoxycarbonyloxy, p-methoxyphenoxycarbonyloxy, p-n-hexadecyloxyphenoxycarbonyloxy), an amino group (preferably an amino group, a substituted or unsubstituted alkylamino group having from 1 to 30 carbon atoms or a substituted or unsubstituted anilino group having from 6 to 30 carbon atoms, e.g., amino, methylamino, dimethylamino, anilino, N-methyl-anilino, diphenylamino), an ammonio group (preferably an ammonio group or an ammonio group substituted by a substituted or unsubstituted alkyl, aryl or heterocyclic group having from 1 to 30 carbon atoms, e.g., trimethylammonio, triethylammonio, diphenylmethylammonio), an acylamino group (preferably a formylamino group, a substituted or unsubstituted alkylcarbonylamino group having from 1 to 30 carbon atoms or a substituted or unsubstituted arylcarbonylamino group having from 6 to 30 carbon atoms, e.g., formylamino, acetylamino, pivaloylamino, lauroylamino, benzoylamino, 3,4,5-tri-n-octyloxyphenylcarbonylamino), an aminocarbonylamino group (preferably a substituted or unsubstituted aminocarbonylamino group having from 1 to 30 carbon atoms, e.g., carbamoylamino, N,N-dimethylaminocarbonylamino, N,N-diethylaminocarbonylamino, morpholinocarbonylamino), an alkoxycarbonylamino group (preferably a substituted or unsubstituted alkoxycarbonylamino group having from 2 to 30 carbon atoms, e.g., methoxycarbonylamino, ethoxycarbonylamino, tert-butoxycarbonylamino, n-octadecyloxycarbonylamino, N-methyl-methoxycarbonylamino), an aryloxycarbonylamino group (preferably a substituted or unsubstituted aryloxycarbonylamino group having from 7 to 30 carbon atoms, e.g., phenoxycarbonylamino, p-chlorophenoxycarbonylamino, m-n-octyloxyphenoxycarbonylamino), a sulfamoylamino group (preferably a substituted or unsubstituted sulfamoylamino group having from 0 to 30 carbon atoms, e.g., sulfamoylamino, N,N-dimethylaminosulfonylamino, N-n-octylaminosulfonylamino), an alkyl- or arylsulfonylamino group (preferably a substituted or unsubstituted alkylsulfonylamino group having from 1 to 30 carbon atoms or a substituted or unsubstituted arylsulfonylamino group having from 6 to 30 carbon atoms, e.g., methylsulfonylamino, butylsulfonylamino, phenylsulfonylamino, 2,3,5-trichlorophenylsulfonylamino, p-methylphenylsulfonylamino), a mercapto group, an alkylthio group (preferably a substituted or unsubstituted alkylthio group having from 1 to 30 carbon atoms, e.g., methylthio, ethylthio, n-hexadecylthio), an arylthio group (preferably a substituted or unsubstituted arylthio group having from 6 to 30 carbon atoms, e.g., phenylthio, p-chlorophenylthio, m-methoxyphenylthio), a heterocyclic thio group (preferably a substituted or unsubstituted heterocyclic thio group having from 2 to 30 carbon atoms, e.g., 2-benzothiazolylthio, 1-phenyltetrazol-5-ylthio), a sulfamoyl group (preferably a substituted or unsubstituted sulfamoyl group having from 0 to 30 carbon atoms, e.g., N-ethylsulfamoyl, N-(3-dodecyloxypropyl)sulfamoyl, N,N-dimethylsulfamoyl, N-acetylsulfamoyl, N-benzoylsulfamoyl, N-(N'-phenylcarbamoyl)sulfamoyl), a sulfo group, an alkyl- or arylsulfinyl group (preferably a substituted or unsubstituted alkylsulfinyl group having from 1 to 30 carbon atoms or a substituted or unsubstituted arylsulfinyl group having from 6 to 30 carbon atoms, e.g., methylsulfinyl, ethylsulfinyl, phenylsulfinyl, p-methylphenylsulfinyl), an alkyl- or arylsulfonyl group (preferably a substituted or unsubstituted alkylsulfonyl group having from 1 to 30 carbon atoms or a substituted or unsubstituted arylsulfonyl group having from 6 to 30 carbon atoms, e.g., methylsulfonyl, ethylsulfonyl, phenylsulfonyl, p-methylphenylsulfonyl), an acyl group (preferably a formyl group, a substituted or unsubstituted alkylcarbonyl group having from 2 to 30 carbon atoms, a substituted or unsubstituted arylcarbonyl group having from 7 to 30 carbon atoms or a substituted or unsubstituted heterocyclic carbonyl group having from 4 to 30 carbon atoms and being bonded to a carbonyl group through a carbon atom, e.g., acetyl, pivaloyl, 2-chloroacetyl, stearoyl, benzoyl, p-n-octyloxyphenylcarbonyl, 2-pyridylcarbonyl, 2-furylcarbonyl), an aryloxycarbonyl group (preferably a substituted or unsubstituted aryloxycarbonyl group having from 7 to 30 carbon atoms, e.g., phenoxycarbonyl, o-chlorophenoxycarbonyl, m-nitrophenoxycarbonyl, p-tert-butylphenoxycarbonyl), an alkoxycarbonyl group (preferably a substituted or unsubstituted alkoxycarbonyl group having from 2 to 30 carbon atoms, e.g., methoxycarbonyl, ethoxycarbonyl, tert-butoxycarbonyl, n-octadecyloxycarbonyl), a carbamoyl group (preferably a substituted or unsubstituted carbamoyl group having from 1 to 30 carbon atoms, e.g., carbamoyl, N-methylcarbamoyl, N,N-dimethylcarbamoyl, N,N-di-n-octylcarbamoyl, N-(methylsulfonyl)carbamoyl), an aryl- or heterocyclic-azo group (preferably a substituted or unsubstituted arylazo group having from 6 to 30 carbon atoms or a substituted or unsubstituted heterocyclic-azo group having from 3 to 30 carbon atoms, e.g., phenylazo, p-chlorophenylazo, 5-ethylthio-1,3,4-thiadiazol-2-ylazo), an imido group (preferably N-succinimido, N-phthalimido), a phosphino group (preferably a substituted or unsubstituted phosphino group having from 2 to 30 carbon atoms, e.g., dimethylphosphino, diphenylphosphino, methylphenoxyphosphino), a phosphinyl group (preferably a substituted or unsubstituted phosphinyl group having from 2 to 30 carbon atoms, e.g., phosphinyl, dioctyloxyphosphinyl, diethoxyphosphinyl), a phosphinyloxy group (preferably a substituted or unsubstituted phosphinyloxy group having from 2 to 30 carbon atoms, e.g., diphenoxyphosphinyloxy, dioctyloxyphosphinyloxy), a phosphinylamino group (preferably a substituted or unsubstituted phosphinylamino group having from 2 to 30 carbon atoms, e.g., dimethoxyphosphinylamino, dimethylaminophosphinylamino), a phospho group, a silyl group (preferably a substituted or unsubstituted silyl group having from 3 to 30 carbon atoms, e.g., trimethylsilyl, tert-butyldimethylsilyl, phenyldimethylsilyl), a hydrazino group (preferably a substituted or unsubstituted hydrazino group having from 0 to 30 carbon atoms, e.g., trimethylhydrazino), or a ureido group (preferably a substituted or unsubstituted ureido group having from 0 to 30 carbon atoms, e.g., N,N-dimethylureido).

The substituent represented by W may also have a structure condensed with a ring (an aromatic or non-aromatic hydrocarbon ring or heterocyclic ring or a polycyclic condensed ring comprising a combination of these rings may be formed, e.g., benzene ring, naphthalene ring, anthracene ring, quinoline ring, phenanthrene ring, fluorene ring, triphenylene ring, naphthacene ring, biphenyl ring, pyrrole ring, furan ring, thiophene ring, imidazole ring, oxazole ring, thiazole ring, pyridine ring, pyrazine ring, pyrimidine ring, pyridazine ring, indolizine ring, indole ring, benzofuran ring, benzothiophene ring, isobenzofuran ring, quinolidine ring, isoquinoline ring, phthalazine ring, naphthylidine ring, quinoxaline ring, quinoxazoline ring, quinoline ring, carbazole ring, phenanthridine ring, acridine ring, phenanthroline ring, thianthrene ring, chromene ring, xanthene ring, phenoxathiine ring, phenothiazine ring, phenazine ring).

Among these substituents W, those having a hydrogen atom may be deprived of the hydrogen atom and substituted by the above-described substituent. Examples of this functional group include an alkylcarbonylaminosulfonyl group, an arylcarbonylaminosulfonyl group, an alkylsulfonylaminocarbonyl group and an arylsulfonylaminocarbonyl group. Specific examples thereof include methylsulfonylaminocarbonyl, p-methylphenylsulfonylaminocarbonyl, acetylaminosulfonyl and benzoylaminosulfonyl.

In formula (1), $L_1$ represents a linking group and may be any linking group but is preferably a linking group having from 0 to 100, preferably from 1 to 20, carbon atoms, constructed by one or a combination of two or more of an alkylene group (preferably having from 1 to 20 carbon atoms (hereinafter referred to as "a C number"), e.g., methylene, ethylene, propylene, butylene, pentylene, hexylene, octylene), an arylene group (preferably having a C number of 6 to 26, e.g., phenylene, naphthylene), an alkenylene group (preferably having a C number of 2 to 20, e.g., ethenylene, propenylene), an alkynylene group (preferably having a C number of 2 to 20, e.g., ethynylene, propynylene), an amido group, an ester group, a sulfoamido group, a sulfonic acid ester group, a ureido group, a sulfonyl group, a sulfinyl group, a thioether group, an ether group, a carbonyl group, —$NR_{51}$— (wherein $R_{51}$ is a hydrogen atom or a monovalent group and preferred examples of the substituent include W) and a heterylene group (preferably having a C number of 1 to 26, e.g., 6-chloro-1,3,5-triazyl-2,4-diyl, pyrimidine-2,4-diyl, quinoxalin-2,3-diyl).

$L_1$ is preferably represented by $-G_1-(A_1-G_2-)_{t1}-$ .

$A_1$ represents, irrespective of the direction, —O—, —S—, —$SO_2$—, —$NR_3$—, —COO—, —$CONR_4$— or —$SO_2NR_5$—, $R_3$ to $R_5$ each independently represents a hydrogen atom, an alkyl group (preferably an unsubstituted alkyl group having from 1 to 18, more preferably from 1 to 7, still more preferably from 1 to 4, carbon atoms (hereinafter referred to as "a C number") (e.g., methyl, ethyl, propyl, isopropyl, butyl, isobutyl, hexyl, octyl, 2-ethylhexyl, dodecyl, octadecyl) or a substituted alkyl group having a C number of 1 to 18, preferably from 1 to 7, more preferably from 1 to 4 (for example, an alkyl group substituted by W described above as a substituent; preferably an aralkyl group (e.g., benzyl, 2-phenylethyl), a hydroxyalkyl group (e.g., 2-hydroxyethyl, 3-hydroxypropyl, 6-hydroxhexyl), a carboxyalkyl group (e.g., 2-carboxyethyl, 3-carboxypropyl, 4-carboxybutyl, carboxymethyl, 5-carboxypentyl), an alkoxyalkyl group (e.g., 2-methoxyethyl, 2-(2-methoxyethoxy)ethyl), an aryloxyalkyl group (e.g., 2-phenoxyethyl, 2-(1-naphthoxy)ethyl), an alkoxycarbonylalkyl group (e.g., ethoxycarbonylmethyl, 2-benzyloxycarbonylethyl), an aryloxycarbonylalkyl group (e.g., 3-phenoxycarbonylpropyl), an acyloxyalkyl group (e.g., 2-acetyloxyethyl), an acylalkyl group (e.g., 2-acetylethyl), a carbamoylalkyl group (e.g., 2-morpholinocarbonylethyl), a sulfamoylalkyl group (e.g., N,N-dimethylsulfamoylmethyl), a sulfoalkyl group (e.g., 2-sulfobenzyl, 3-sulfo-3-phenylpropyl, 2-sulfoethyl, 3-sulfopropyl, 3-sulfobutyl, 4-sulfobutyl, 2-[3-sulfopropoxy]ethyl, 2-hydroxy-3-sulfopropyl, 3-sulfopropoxyethoxyethyl), a sulfatoalkyl group (e.g., 2-sulfatoethyl, 3-sulfatoproyl, 4-sulfatobutyl), a heterocyclic ring-substituted alkyl group (e.g., 2-(pyrrolidin-2-on-1-yl)ethyl, tetrahydrofurfuryl), an alkylsulfonylcarbamoylalkyl group (e.g., methansulfonylcarbamoylmethyl), an acylcarbamoylalkyl group (e.g., acetylcarbamoylmethyl), an acylsulfamoylalkyl group (e.g., acetylsulfamoylmethyl), an alkylsulfonylsulfamoylalkyl group (e.g., methanesulfonylsulfamoylmethyl) or a halogen-substituted alkyl group (e.g., 2-chloroethyl, 2,2,2-trifluoroethyl)}], an alkenyl group (preferably an alkenyl group having a C number of 2 to 20, e.g., vinyl, allyl, 3-butenyl, oleyl, or an alkenyl group substituted by W, such as sulfoalkenyl group (e.g., 3-sulfo-2-propenyl)), an aryl group (an unsubstituted aryl group having a C number of 6 to 20, preferably from 6 to 10, more preferably from 6 to 8 (e.g., phenyl, 1-naphthyl, 2-naphthyl) or a substituted aryl group having a C number of 6 to 20, preferably from 6 to 10, more preferably from 6 to 8 (for example, an aryl group substituted by W described above as examples of the substituent, specifically, a p-methoxyphenyl group, a p-methylphenyl group or a p-chlorophenyl group)), a heterocyclic group (an unsubstituted heterocyclic group having a C number of 1 to 20, preferably from 3 to 10, more preferably from 4 to 8 (e.g., 2-furyl, 2-thienyl, 2-pyridyl, 3-pyrazolyl, 3-isooxazolyl, 3-isothiazolyl, 2-imidazolyl, 2-oxazolyl, 2-thiazolyl, 2-pyridazyl, 2-pyrimidyl, 3-pyrazyl, 2-(1,3,5-triazolyl), 3-(1,2,4-triazolyl), 5-tetrazolyl), or a substituted heterocyclic group having a C number of 1 to 20, preferably from 3 to 10, more preferably from 4 to 8 (for example, a heterocyclic group substituted by W described above as examples of the substituent, specifically, a 5-methyl-2-thienyl group or a 4-methoxy-2-pyridyl group)).

$R_3$ is preferably a hydrogen atom or an alkyl group, more preferably an alkyl group.

$R_4$ and $R_5$ each is preferably a hydrogen atom or an alkyl group, more preferably a hydrogen atom.

$A_1$ preferably represents —O—, —$SO_2$—, —COO— or —$CONR_4$—, more preferably —O— or —$CONR_4$—.

$G_1$ and $G_2$ each independently represents an alkylene group, an alkenylene group or an arylene group (preferred examples of these groups are the same as those described above for $L_1$) and may be substituted by the above-described substituent W, but $G_1$ and $G_2$ both are preferably an alkylene group, more preferably a linear unsubstituted alkylene group having a C number of 1 to 8.

t1 represents an integer of 1 to 10, preferably an integer of 1 to 4, more preferably an integer of 1 to 3. When t1 is 2 or more, multiple $A_1$'s may be the same or different and multiple $G_2$'s may also be the same or different.

When t1 is 1, $A_1$ is preferably —COO—, —$CONR_4$— or —$SO_2NR_5$—, more preferably —COO— or —$CONR_4$—, still more preferably —$CONR_4$— (preferably —CONH—).

When t1 is 2 or more, at least one $A_1$ is preferably —COO—, —$CONR_4$— or —$SO_2NR_5$—, more preferably —COO— or —$CONR_4$—, still more preferably —$CONR_4$—(preferably —CONH—). The remaining $A_1$ is preferably —COO—, —$CONR_4$—, —$SO_2NR_5$—, —O— or —$SO_2$—, more preferably —O— or —$CONR_4$— (preferably —CONH—).

m1 represents an integer of 1 to 5, preferably 1 or 2, more preferably 1, and m2 represents an integer of 1 to 5, preferably 1 or 2, more preferably 1.

Dye1 represents a first chromophore. The chromophore represented by Dye1 may be any chromophore and examples thereof include cyanine dyes, styryl dyes, hemicyanine dyes, merocyanine dyes, trinuclear merocyanine dyes, tetranuclear merocyanine dyes, rhodacyanine dyes, complex cyanine dyes, complex merocyanine dyes, allopolar dyes, oxonol dyes, hemioxonol dyes, squarylium dyes, croconium dyes, azomethine dyes, coumarin dyes, arylidene dyes, anthraquinone dyes, triphenylmethane dyes, azo dyes, azomethine dyes, spiro compounds, metallocene dyes, fluorenone dyes, fulgide dyes, perylene dyes, phenazine dyes, phenothiazine dyes, quinone dyes, indigo dyes, diphenylmethane dyes, polyene dyes, acridine dyes, acridinone dyes, diphenylamine dyes, quinacridone dyes, quinophthalone dyes, phenoxazine dyes, phthaloperylene dyes, porphyrin dyes, chlorophyll dyes, phthalocyanine dyes and metal complex dyes.

Among these, preferred are cyanine dyes, styryl dyes, hemicyanine dyes, merocyanine dyes, trinuclear merocyanine dyes, tetranuclear merocyanine dyes, rhodacyanine dyes, complex cyanine dyes, complex merocyanine dyes, allopolar dyes, oxonol dyes, hemioxonol dyes, squarylium dyes, croconium dyes, and polymethine chromophores such as azamethine dye and oxonol dye. These dyes are described in detain in F. M. Harmer, *Heterocyclic Compounds—Cyanine Dyes and Related Compounds*, John Wiley & Sons, New York, London (1964), D. M. Sturmer, *Heterocyclic Compounds—Special topics in heterocyclic chemistry*, Chap. 18, Section 14, pp. 482–515. Examples of the formulae for preferred dyes include the formulae described in U.S. Pat. No. 5,994,051, pp. 32–36, and the formulae described in U.S. Pat. No. 5,747,236, pp. 30–34. Preferred examples of the cyanine dye, the merocyanine dye and the rhodacyanine dye include those represented by formulae (XI), (XII) and (XIII) of U.S. Pat. No. 5,340,694, columns 21 to 22 (on the condition that the numbers of n12, n15, n17 and n18 are not limited and each is an integer of 0 or more (preferably 4 or less)).

Dye1 is preferably a cyanine chromophore, a merocyanine dye or an oxonol chromophore, more preferably a cyanine chromophore or a merocyanine chromophore, most preferably a cyanine chromophore.

The cyanine chromophore is preferably a chromophore represented by the following formula (4):

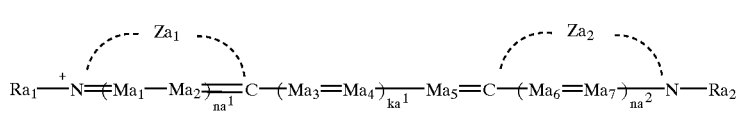

wherein $Za_1$ and $Za_2$ each represents an atomic group for forming a 5- or 6-membered nitrogen-containing heterocyclic ring and this ring may further be condensed with a benzene ring, a benzofuran ring, a pyridine ring, a pyrrole ring, an indole ring or a thiophene ring.

$Ra_1$ and $Ra_2$ each represents a hydrogen atom, an alkyl group, an alkenyl group, an aryl group or a heterocyclic group (preferred examples of these groups are the same as those described for $R_3$ to $R_5$), preferably a hydrogen atom or an alkyl group, more preferably an unsubstituted alkyl group or a sulfoalkyl group.

$Ma_1$ to $Ma_7$ each represents a methine group and may have a substituent. The substituent may be any of the above-described substituents W but is preferably an alkyl group having a C number of 1 to 20 (e.g., methyl, ethyl, i-propyl), a halogen atom (e.g., chlorine, bromine, iodine, fluorine), a nitro group, an alkoxy group having a C number of 1 to 20 (e.g., methoxy, ethoxy), an aryl group having a C number of 6 to 26 (e.g., phenyl, 2-naphthyl), a heterocyclic group having a C number of 0 to 20 (e.g., 2-pyridyl, 3-pyridyl), an aryloxy group having a C number of 6 to 20 (e.g., phenoxy, 1-naphthoxy, 2-naphthoxy), an acylamino group having a C number of 1 to 20 (e.g., acetylamino, benzoylamino), a carbamoyl group having a C number of 1 to 20 (e.g., N,N-dimethylcarbamoyl), a sulfo group, a hydroxy group, a carboxy group, an alkylthio group having a C number of 1 to 20 (e.g., methylthio) or a cyano group. The methine group may form a ring together with another methine group or with an auxochrome. $Ma_1$ to $Ma_7$ each is preferably an unsubstituted methine group, an ethyl group-substituted methine group or a methyl group-substituted methine group. $na^1$ and $na^2$ each is 0 or 1, preferably 0. $ka^1$ represents an integer of 0 to 3, preferably from 0 to 2, more preferably 0 or 1. When $ka^1$ is 2 or more, the methine groups $Ma_3$ may be the same or different and the methine groups $Ma_4$ may also be the same or different.

CI represents an ion for neutralizing the electric charge. y represents a number necessary for neutralizing the electric charge.

The merocyanine chromophore is preferably a chromophore represented by the following formula (5):

(5)

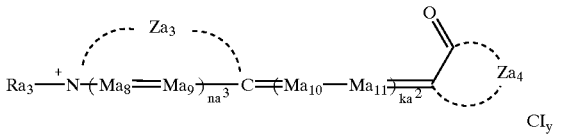

wherein $Za_3$ represents an atomic group for forming a 5- or 6-membered nitrogen-containing heterocyclic ring and this ring may further be condensed with a benzene ring, a benzofuran ring, a pyridine ring, a pyrrole ring, an indole ring or a thiophene ring. $Za_4$ represents an atomic group for forming an acidic nucleus. $Ra_3$ represents a hydrogen atom, an alkyl group, an alkenyl group, an aryl group or a heterocyclic group (preferred examples of these groups are the same as those described for $Ra_1$ and $Ra_2$) $Ma_8$ to $Ma_{11}$ each represents a methine group (preferred examples thereof are the same as those described for $Ma_1$ to $Ma_7$). $na^3$ is 0 or 1.

$ka^2$ represents an integer of 0 to 3, preferably from 0 to 2, more preferably 1 or 2. When $ka^2$ is 2 or more, the methine groups $Ma_{10}$ may be the same or different and the methine groups $Ma_{11}$ may also be the same or different.

CI represents an ion for neutralizing the electric charge. y represents a number necessary for neutralizing the electric charge.

The oxonol chromophore is preferably a chromophore represented by the following formula (6):

(6)

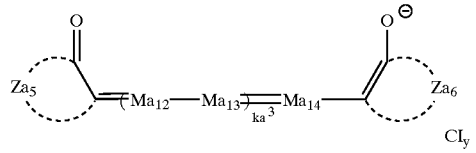

wherein $Za_5$ and $Za_6$ each represents an atomic group for forming an acidic nucleus, $Ma_{12}$ to $Ma_{14}$ each represents a methine group (preferred examples thereof are the same as those described for $Ma_1$ to $Ma_7$), $ka^3$ represents an integer of 0 to 3, preferably from 0 to 2 and when $ka^3$ is 2 or more, the methine groups $Ma_{12}$ may be the same or different and the methine groups $Ma_{13}$ may also be the same or different, CI represents an ion for neutralizing the electric charge, and y represents a number necessary for neutralizing the electric charge.

Examples of $Za_1$, $Za_2$ and $Za_3$ include oxazole nuclei having from 3 to 25 carbon atoms (e.g., 2-3-methyloxazolyl, 2-3-ethyloxazolyl, 2-3,4-diethyloxazolyl, 2-3-methylbenzoxazolyl, 2-3-ethylbenzoxazolyl, 2-3-sulfoethylbenzoxazolyl, 2-3-sulfopropylbenzoxazolyl, 2-3-methylthioethylbenzoxazolyl, 2-3-methoxyethylbenzoxazolyl, 2-3-sulfobutylbenzoxazolyl, 2-3-methyl-β-naphthoxazolyl, 2-3-methyl-α-naphthoxazolyl, 2-3-sulfopropyl-β-naphthoxazolyl, 2-3-sulfopropyl-γ-naphthoxazolyl, 2-3-(3-naphthoxyethyl) benzoxazolyl, 2-3,5-dimethylbenzoxazolyl, 2-6-chloro-3-methylbenzoxazolyl, 2-5-bromo-3-methylbenzoxazolyl, 2-3-ethyl-5-methoxybenzoxazolyl, 2-5-phenyl-3-sulfopropylbenzoxazolyl, 2-5-(4-bromophenyl)-3-sulfobutylbenzoxazolyl, 2-3-dimethyl-5,6-dimethylbenzoxazolyl), thiazole nuclei having from 3 to 25 carbon atoms (e.g., 2-3-methylthiazolyl, 2-3-ethylthiazolyl, 2-3-sulfopropylthiazolyl, 2-3-sulfobutylthiazolyl, 2-3,4-dimethylthiazolyl, 2-3,4,4-trimethylthiazolyl, 2-3-carboxyethylthiazolyl, 2-3-methylbenzothiazolyl, 2-3-ethylbenzothiazolyl, 2-3-butylbenzothiazolyl, 2-3-sulfopropylbenzothiazolyl, 2-3-sulfobutylbenzothiazolyl, 2-3-methyl-β-naphthothiazolyl, 2-3-sulfopropyl-γ-naphthothiazolyl, 2-3-(1-naphthoxyethyl)benzothiazolyl, 2-3,5-dimethylbenzothiazolyl, 2-6-chloro-3-methylbenzothiazolyl, 2-6-iodo-3-methylbenzothiazolyl, 2-5-bromo-3-methylbenzothiazolyl, 2-3-ethyl-5-methoxybenzothiazolyl, 2-5-phenyl-3-sulfopropylbenzothiazolyl, 2-5-(4-bromophenyl)-3-sulfobutylbenzothiazolyl, 2-3-dimethyl-5,6-dimethylbenzothiazolyl), imidazole nuclei having from 3 to 25 carbon atoms (e.g., 2-1,3-diethylimidazolyl, 2-1,3-dimethylimidazolyl, 2-1-methylbenzimidazolyl, 2-1,3,4-triethylimidazolyl, 2-1,3-diethylbenzimidazolyl, 2-1,3,5-trimethylbenzimidazolyl, 2-6-chloro-1,3-dimethylbenzimidazolyl, 2-5,6-dichloro-1,3-diethylbenzimidazolyl, 2-1,3-disulfopropyl-5-cyano-6-chlorobenzimidazolyl), indolenine nuclei having from 10 to 30 carbon atoms (e.g., 3,3-dimethylindolenine), quinoline nuclei having from 9 to 25 carbon atoms (e.g., 2-1-methylquinolyl, 2-1-ethylquinolyl, 2-1-methyl-6-chloroquinolyl, 2-1,3-diethylquinolyl, 2-1-methyl-6-methylthioquinolyl, 2-1-sulfopropylquinolyl, 4-1-methylquinolyl, 4-1-sulfoethylquinolyl, 4-1-methyl-7-chloroquinolyl, 4-1,8-diethylquinolyl, 4-1-methyl-6-methylthioquinolyl, 4-1-sulfopropylquinolyl), selenazole nuclei having from 3 to 25 carbon atoms (e.g., 2-3-methylbenzoselenazolyl), pyridine nuclei having from 5 to 25 carbon atoms (e.g., 2-pyridyl), thiazoline nuclei, oxazoline nuclei, selenazoline nuclei, tetrazoline nuclei, tetrazole nuclei, benzotellurazole nuclei, imidazoline nuclei, imidazo [4,5-quinoxaline] nuclei, oxadiazole nuclei, thiadiazole nuclei, tetrazole nuclei, pyrimidine nuclei and pyrazole nuclei.

These nuclei each may be substituted and examples of the substituent include the above-described substituents W. The substituent is preferably, for example, an alkyl group (e.g., methyl, ethyl, propyl), a halogen atom (e.g., chlorine, bromine, iodine, fluorine), a nitro group, an alkoxy group (e.g., methoxy, ethoxy), an aryl group (e.g., phenyl), a heterocyclic group (e.g., 2-pyridyl, 3-pyridyl, 1-pyrrolyl, 2-thienyl), an aryloxy group (e.g., phenoxy), an acylamino group (e.g., acetylamino, benzoylamino), a carbamoyl group (e.g., N,N-dimethylcarbamoyl), a sulfo group, a sulfonamido group (e.g., methanesulfonamido), a sulfamoyl group (e.g., N-methylsulfamoyl), a hydroxy group, a carboxy group, an alkylthio group (e.g., methyl thio) or a cyano group.

$Za_1$, $Za_2$ and $Za_3$ each is preferably an oxazole nucleus, an imidazole nucleus, a thiazole nucleus or a pyrazole nucleus.

These heterocyclic rings each may further be condensed with a ring such as benzene ring, benzofuran ring, pyridine ring, pyrrole ring, indole ring or thiophene ring.

$Za_4$, $Za_5$ and $Za_6$ each represents an atomic group necessary for forming an acidic nucleus and the acidic nucleus is defined in James (compiler), *The Theory of the Photographic Process*, 4th ed., Macmillan, page 198 (1977). Specific examples thereof include nuclei such as 2-pyrazolon-5-one, pyrazolidine-3,5-dione, imidazolin-5-one, hydantoin, 2- or 4-thiohydantoin, 2-iminooxazolidin-4-one, 2-oxazolin-5-one, 2-thiooxazoline-2,4-dione, isorhodanine, rhodamine, indane-1,3-dione, thiophen-3-one, thiophen-3-one-1,1,-dioxide, indolin-2-one, indolin-3-one, 2-oxoindazolium, 5,7-dioxo-6,7-dihydrothiazolo[3,2-a] pyrimidine, 3,4-dihydroisoquinolin-4-one, 1,3-dioxane-4,6-dione, barbituric acid, 2-thiobarbituric acid, coumarin-2,4-dione, indazolin-2-one, pyrido[1,2-a]pyrimidine-1,3-dione, pyrazolo[1,5-b]quinazolone and pyrazolopyridone. Among these, preferred are hydantoin, rhodanine, barbituric acid and 2-oxazolin-5-one.

$Za_4$ is preferably a barbituric acid.

Specific examples of the cyanine chromophore, the merocyanine chromophore and the oxonol chromophore include those described in F. M. Harmer, *Heterocyclic Compounds—Cyanine Dyes and Related Compounds*, John & Wiley & Sons, New York, London (1964).

The formulae of cyanine dyes and merocyanine dyes are preferably formulae (XI) and (XII) of U.S. Pat. No. 5,340,694, pages 21 and 22 (however, the numbers of n12 and n15 are not limited and each is an integer of 0 or more (preferably an integer of 0 to 4)).

Dye2 represents a second chromophore and Dye2 represents a merocyanine dye having in the acidic nucleus at least one dissociative group having a pKa of 5 or less. Accordingly, Dye2 preferably has a structure where at least one dissociative group is substituted to the merocyanine chromophore represented by formula (5), more preferably where at least one dissociative group is substituted to the acidic nucleus. In other words, in formula (5), at least one dissociative group is more preferably substituted to $Za_4$.

The "pKa" as used herein is a value in water at 25° C. As for the pKa value, the values described in *Kagaku Binran, Kisohen* (*Handbook of Chemistry, Elementary*), II-316 to II-321, and Hide Iwamura (compiler), *Daigakuin Yuki Kagaku, Jo* (*Organic Chemistry of Graduate Course, First Half Volume*), pp. 168–169, can be referred to.

The dissociative group is preferably —$SO_3M$, —$OSO_3M$, —$PO_3M_2$, —$OPO_3M_2$ or —COOM (wherein M represents proton or cation (preferred examples thereof are the same as those described later for the cation of CI)), preferably —$SO_3M$.

The compound represented by formula (1) of the present invention is preferably represented by formula (2).

In formula (2), $G_1$, $G_2$, $A_1$ and t1 have the same meanings as defined in (4) above.

$X_1$, $X_2$ and $X_{11}$ each independently represents —O—, —S—, —$NR_6$— or —$CR_7R_8$—, $R_6$ to $R_8$ each independently represents a hydrogen atom, an alkyl group, an alkenyl group, an aryl group or a heterocyclic group (preferred examples of these groups are the same as those described for $R_3$ to $R_5$), $R_6$ preferably represents a hydrogen atom or an alkyl group, more preferably an unsubstituted alkyl group or a sulfoalkyl group, and $R_7$ and $R_8$ each preferably represents an unsubstituted alkyl group.

$X_1$ and $X_2$ each is preferably —O— or —S—, more preferably —S—, and $X_{11}$ is preferably —O—.

$R_1$, $R_2$ and $R_{21}$ each independently represents a hydrogen atom, an alkyl group, an alkenyl group, an aryl group or a heterocyclic group (preferred examples of these groups are the same as those described for $Ra_1$ and $Ra_2$), preferably a hydrogen atom or an alkyl group, more preferably an unsubstituted alkyl group or an acid-substituted alkyl group (the acid radical is, for example, a carboxy group, a sulfo group, a phosphate group, a sulfonamide group, a sulfamoyl group or an acylsulfonamide group). The acid-substituted alkyl group is preferably a sulfoalkyl group.

$R_1$, $R_2$ and $R_{21}$ each is more preferably an unsubstituted alkyl group or a sulfoalkyl group.

$M_1$ to $M_3$, $M_{21}$ and $M_{22}$ each independently represents a methine group (preferred examples are the same as those described for $Ma_1$ to $Ma_4$), preferably an unsubstituted methine group, an ethyl group-substituted methine group or a methyl group-substituted methine group.

n1 and n21 each independently represents an integer of 0 to 3. n1 is preferably an integer of 0 to 2, more preferably 0 or 1, and n21 is preferably an integer of 0 to 2, more preferably 1 or 2.

When n1 and n21 each is 2 or more, the methine groups represented by $M_1$, $M_2$, $M_{21}$ or $M_{22}$ may be the same or different. n21 is preferably n1+1, more specifically, when n1 is 0, n21 is preferably 1 and when n1 is 1, n21 is preferably 2.

When n1 is 0, $X_1$ and $X_2$ both are preferably —S— and n21 is preferably 1, and when n1 is 1, $X_1$ and $X_2$ both are preferably —O— and n 21 is preferably 2.

$V_1$, $V_2$ and $V_{21}$ each represents a substituent and although the substituent may be any one of the above-described substituents W, preferred examples thereof include an alkyl group having a C number of 1 to 20 (preferred examples are the same as those for $R_3$ to $R_5$), a halogen atom (e.g., chlorine, bromine, iodine, fluorine), a nitro group, an alkoxy group having a C number of 1 to 20 (e.g., methoxy, ethoxy), an aryl group having a C number of 6 to 26 (e.g., phenyl, 2-naphthyl), a heterocyclic group having a C number of 0 to 20 (e.g., 2-pyridyl, 3-pyridyl, 1-pyrrolyl, 2-thienyl), an aryloxy group having a C number of 6 to 20 (e.g., phenoxy, 1-naphthoxy, 2-naphthoxy), an acylamino group having a C number of 1 to 20 (e.g., acetylamino, benzoylamino), a carbamoyl group having a C number of 1 to 20 (e.g., N,N-dimethylcarbamoyl), a sulfo group, a sulfonamido group having a C number of 0 to 20 (e.g., methanesulfonamido), a sulfamoyl group having a C number of 0 to 20 (e.g., N-methylsulfamoyl), a hydroxyl group, a carboxyl group, an alkylthio group having a C number of 1 to 20 (e.g., methylthio) and a cyano group. $V_1$ and $V_2$ each is preferably an alkyl group, a halogen atom (particularly, chlorine or bromine), an aryl group, an acylamino group, a carbamoyl group or an alkoxy group. The substituted site is preferably 5- or 6-position.

$V_{21}$ is preferably an alkyl group, a halogen atom, an aryl group, an acylamino group, a carbamoyl group, an alkoxy group, a hydroxyl group, a sulfo group or a carboxyl group, more preferably a hydroxyl group, a sulfo group or a carboxyl group, still more preferably a sulfo group. The substituted site is preferably 5- or 6-position.

n2, n3 and n22 each independently represents an integer of 0 to 4, preferably from 0 to 2. When n2, n3 and n22 each is 2 or more, the substituents represented by $V_1$, $V_2$ or $V_3$ may be the same or different or may be combined with each other to form a ring. The ring formed is preferably a benzene ring, a pyridine ring, a benzofuran ring, a thiophene ring, a pyrrole ring or an indole ring, more preferably a benzene ring.

In the formulae, $R_{22}$ and $R_{29}$ each independently represents a hydrogen atom, an alkyl group, an alkenyl group, an aryl group or a heterocyclic group (preferred examples of these groups are the same as those described for $R_3$ to $R_5$), preferably a hydrogen atom, an alkyl group, or an aryl group, more preferably an alkyl group, or an aryl group.

CI represents ion for neutralizing the electricharge. Whether a certain compound is cation or anion or has net ion charge depends on the substituent thereof. The cation is typically ammonium ion or alkali metal ion. On the other than, the anion may be either inorganic ion or organic ion.

Examples of the cation include sodium ion, potassium ion, triethylammonium ion, diethyl (i-propyl) ammonium ion, pyridinium ion and 1-ethylpyridinium ion. Examples of the anion include halide anion (e.g., chloride ion, bromide ion, fluoride ion, iodide ion), substituted arylsulfonate ion (e.g., paratoluenesulfonate ion), alkylsulfate ion (e.g., methylsulfate ion), sulfate ion, perchlorate ion, tetrafluoroborate ion and acetate ion.

y represents a number necessary for neutralizing the electric charge.

The ring formed by Q in formula (2) is represented by any one of formulae (3-1) to (3-4).

In these formulae, $R_{25}$ to $R_{27}$ each independently represents a hydrogen atom, an alkyl group, an alkenyl group, an aryl group, a heterocyclic group (preferred examples of these groups are the same as those described for $R_3$ to $R_5$) or $R_9$-$L_{11}$-, preferably a hydrogen atom, an alkyl group, an aryl group, or $R_9$-$L_{11}$-, more preferably an alkyl group, an aryl group or $R_9$-$L_{11}$-.

$R_9$ represents a dissociative group having a pKa of 5 or less. The dissociative group is preferably —$SO_3M$, —$OSO_3M$, —$PO_3M_2$, —$OPO_3M_2$ or —COOM (wherein M represents proton or cation), more preferably —$SO_3M$. However, in the case where Dye1 is a cationic dye, M is sometimes not necessary in connection with neutralization of the electric charge.

$L_{11}$ represents a linking group and may be any linking group but is preferably an alkylene group (preferably having from 1 to 20 carbon atoms (hereinafter referred to as "a C number"), e.g., methylene, ethylene, propylene, butylene, pentylene, hexylene, octylene), an arylene group (preferably having a C number of 6 to 26, e.g., phenylene, naphthylene) or an alkynylene group (preferably having a C number of 2 to 20, e.g., ethynylene, propynylene). These groups each may be substituted by the above-described substituent W.

$L_{11}$ is preferably an alkylene group which may be substituted or a phenylene group which may be substituted, more preferably a linear unsubstituted alkylene group having a C number of 1 to 8 or an unsubstituted phenylene group, still more preferably an ethylene group, a 1,2-phenylene group or a 1,4-phenylene group, particularly preferably a 1,2-phenylene group or a 1,4-phenylene group, and most preferably a 1,2-phenylene group.

$R_{28}$ represents a substituent, a hydrogen atom or $R_9$-$L_{11}$-. The substituent may be any one of the above-described substituents W, but preferred examples thereof include an alkyl group having a C number of 1 to 20 (preferred examples are the same as those for $R_3$ to $R_5$), a halogen atom (e.g., chlorine, bromine, iodine, fluorine), a nitro group, an alkoxy group having a C number of 1 to 20 (e.g., methoxy, ethoxy), an aryl group having a C number of 6 to 26 (e.g., phenyl, 2-naphthyl), a heterocyclic group having a C number of 0 to 20 (e.g., 2-pyridyl, 3-pyridyl, 1-pyrrolyl, 2-thienyl), an aryloxy group having a C number of 6 to 20 (e.g., phenoxy, 1-naphthoxy, 2-naphthoxy), an acylamino group having a C number of 1 to 20 (e.g., acetylamino, benzoylamino), a carbamoyl group having a C number of 1 to 20 (e.g., N,N-dimethylcarbamoyl), a sulfo group, a sulfonamido group having a C number of 0 to 20 (e.g., methanesulfonamido), a sulfamoyl group having a C number of 0 to 20 (e.g., N-methylsulfamoyl), an alkoxycarbonyl group having a C number of 2 to 20 (e.g., ethoxycarbonyl), an amino group having a C number of 0 to 20 (e.g., dimethylamino, anilino), a hydroxyl group, a carboxyl group, an alkylthio group having a C number of 1 to 20 (e.g., methylthio) and a cyano group.

$R_{28}$ is preferably a hydrogen atom, an alkyl group, an alkoxy group, an aryl group, an acylamino group, a carbamoyl group, a sulfo group, an alkoxycarbonyl group, a hydroxyl group, a carboxyl group, a cyano group or $R_9$-$L_{11}$-. However, either one of $R_{25}$ and $R_{26}$ is $R_9$-$L_{11}$- and either one of $R_{27}$ and $R_{28}$ is $R_9$-$L_{11}$-.

$X_{22}$ and $X_{24}$ each independently represents an oxygen atom or a sulfur atom. Preferably, $X_{22}$ and $X_{24}$ both are an oxygen atom.

The ring formed by Q is preferably represented by formula (3-1).

$G_1$ is connected to Dye1 through $R_1$ or $V_1$ and $G_2$ is connected to Dye2 through $R_{21}$, $R_{22}$, $R_{25}$, $R_{26}$, $R_{27}$, $R_{28}$, $R_{29}$ or $V_{21}$. At this time, the groups resulting from removing one hydrogen atom at the terminal of $G_1$, $G_2$, $R_1$, $R_2$, $V_1$, $V_{21}$, $R_{21}$, $R_{22}$, $R_{25}$, $R_{26}$, $R_{27}$, $R_{28}$ or $R_{29}$ are connected with each other, however, this does not necessarily mean that the compound is produced by such a synthesis method.

Preferred examples of $V_1$ and $V_{21}$, when connected with $G_1$ or $G_2$, include a carboxy group, an alkoxy group, an acylamino group, a carbamoyl group, a sulfonamido group, a sulfamoyl group, a hydroxy group or an alkylthio group. Among these, more preferred are an acylamino group and a carbamoyl group.

$G_1$ is preferably connected with $R_1$ and $G_2$ is preferably connected with $R_{22}$, $R_{25}$, $R_{26}$, $R_{27}$, $R_{28}$ or $R_{29}$. In this case, $R_1$, $R_{21}$ and $R_{22}$ to $R_{29}$ each is preferably a hydrogen atom.

Preferred examples of Dye1 in the compound represented by (1) or (2) are set forth below, however, the present invention is not limited thereto. The following structural formulae of the compounds of the present invention are only one limiting structure and the compounds each may have other structure which can be formed by resonance.

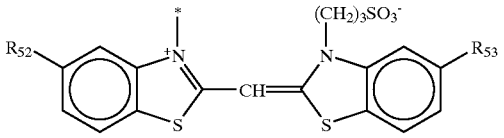
| | $R_{52}$ | $R_{53}$ |
|---|---|---|
| DA-1 | -Ph | —Cl |
| DA-2 | —Cl | —Cl |
| DA-3 | -Ph | -Ph |
| DA-4 | —Cl | —H |
| DA-5 | 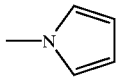 | —Cl |
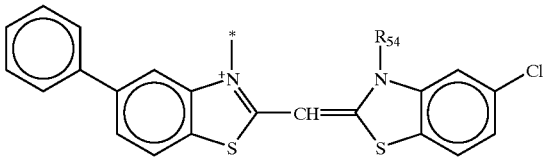
| | $R_{54}$ |
|---|---|
| DA-6 | $-(CH_2)_4-SO_3^-$ |
| DA-7 | $-(CH_2)_2-CH(CH_3)SO_3^-$ |
| DA-8 | $—C_2H_5$ |
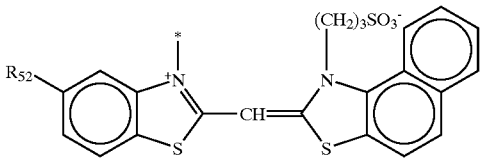
| | $R_{52}$ |
|---|---|
| DA-9 | —Cl |
| DA-10 | $—OCH_3$ |
| DA-11 | -Ph |
DA-12
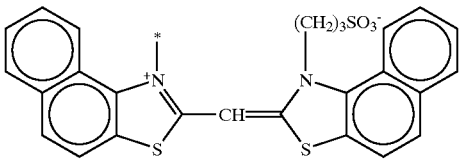
DA-13
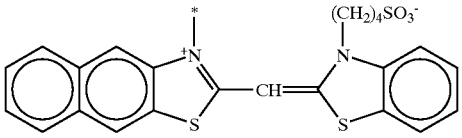
DA-14
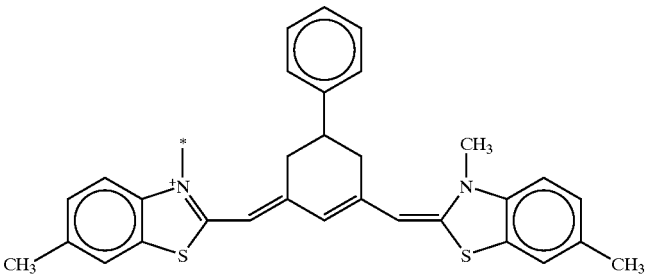

-continued
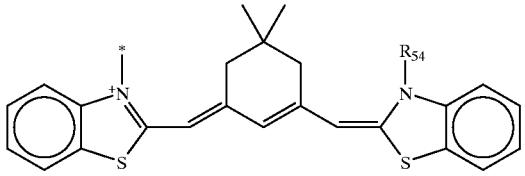
| | $R_{54}$ |
|---|---|
| DA-15 | $—C_2H_5$ |
| DA-16 | $—(CH_2)_3—SO_3^-$ |
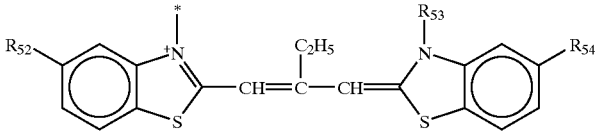
| | $R_{52}$ | $R_{53}$ | $R_{54}$ |
|---|---|---|---|
| DA-17 | —Cl | —Cl | $—(CH_2)_3—SO_3^-$ |
| DA-18 | $—CH_3$ | $—CH_3$ | $—(CH_2)_3—SO_3^-$ |
| DA-19 | —Cl | —Cl | $—CH_2CONH—(CH_2)_2—SO_3^-$ |
| DA-20 | —Cl | —Cl | $—CH_2CH(OH)CH_2SO_3^-$ |
DA-21
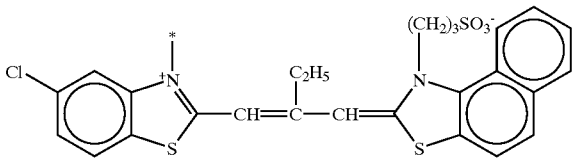
DA-22
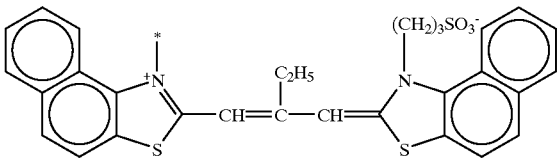
DA-23
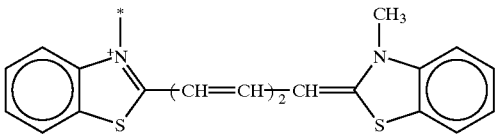
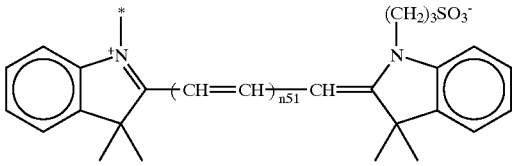
| | $n_{51}$ |
|---|---|
| DA-24 | 1 |
| DA-25 | 2 |
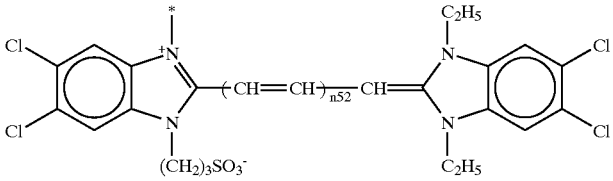
| | $n_{52}$ |
|---|---|

-continued
| | |
|---|---|
| DA-26 | 0 |
| DA-27 | 1 |
| DA-28 | 2 |
DA-29
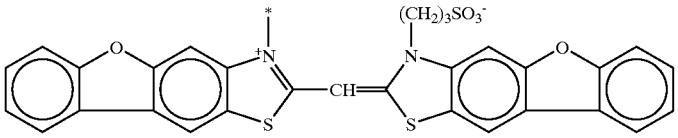
DA-30
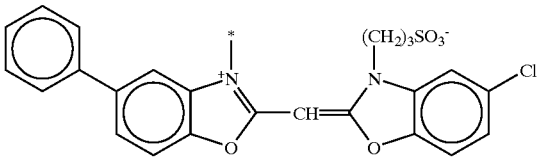
DA-31
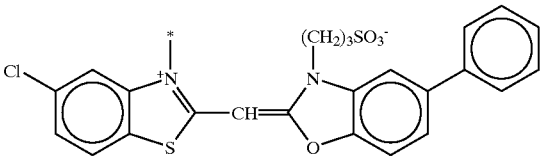
DA-32
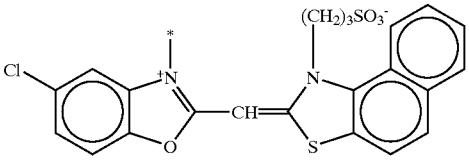
DA-33
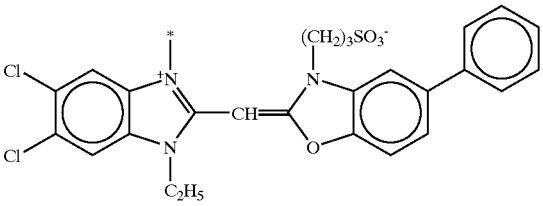
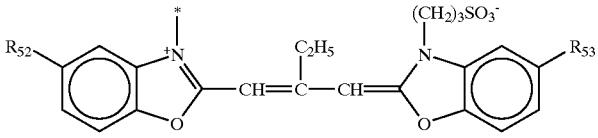
| | $R_{52}$ | $R_{53}$ |
|---|---|---|
| DA-34 | —Br | —Br |
| DA-35 | -Ph | —Cl |
| DA-36 | —Cl | —Cl |
| DA-37 | -Ph | -Ph |
DA-38
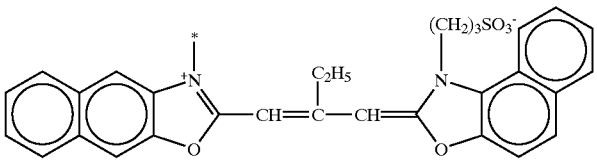
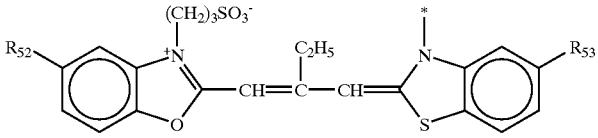

-continued
| | $R_{52}$ | $R_{53}$ |
|---|---|---|
| DA-39 | —Cl | —Cl |
| DA-40 | -Ph | —$CH_3$ |
| DA-41 | —$OCH_3$ | —$CH_3$ |
DA-42
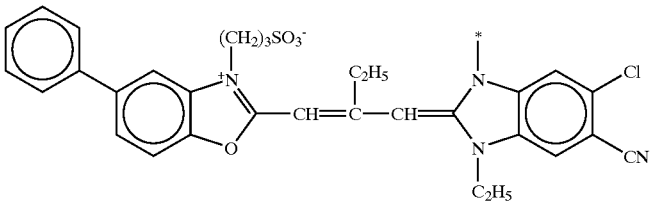
DA-43
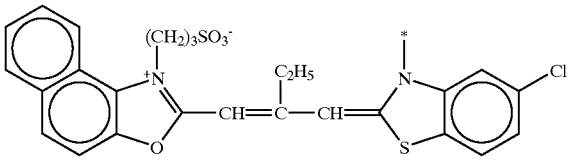
DA-44
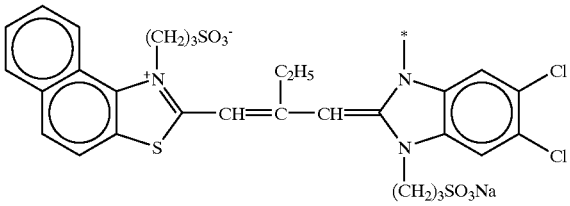
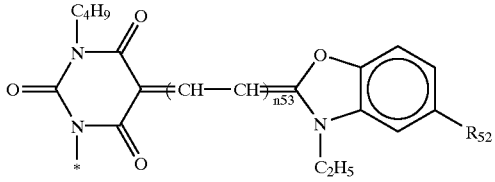
| | $n_{53}$ | $R_{52}$ |
|---|---|---|
| DA-45 | 1 | H |
| DA-46 | 1 | —$SO_3Na$ |
| DA-47 | 2 | H |
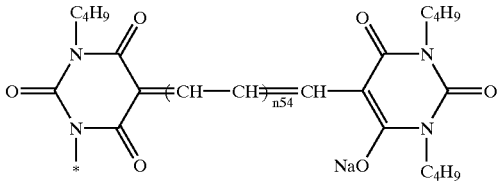
| | $n_{54}$ |
|---|---|
| DA-48 | 0 |
| DA-49 | 1 |
| DA-50 | 2 |
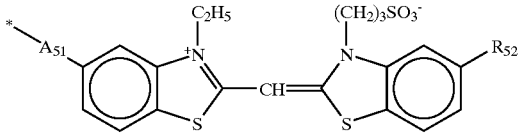
| | $A_{51}$ | $R_{52}$ |
|---|---|---|
| DA-51 | —O— | -Ph |

-continued
| | | |
|---|---|---|
| DA-52 | —OC(=O)— | " |
| DA-53 | —NHCO— | " |
| DA-54 | —$NHSO_2$— | " |
| DA-55 | —CONH— | " |
| DA-56 | —$SO_2NH$— | " |
| DA-57 | —NHCO— | —Cl |
DA-58
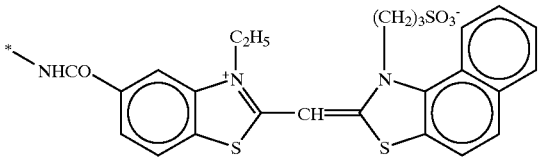
DA-59
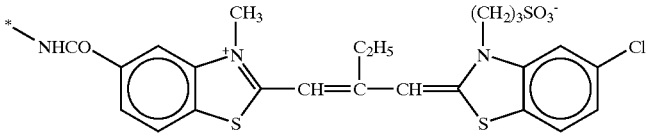
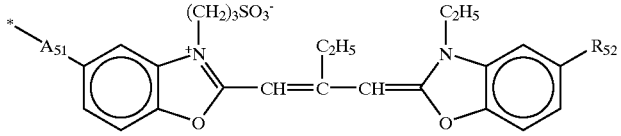
| | $A_{51}$ | $R_{52}$ |
|---|---|---|
| DA-60 | —NHCO— | —Br |
| DA-61 | —CONH— | —Cl |
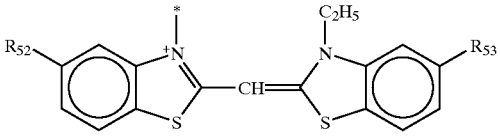
| | $R_{52}$ | $R_{53}$ |
|---|---|---|
| DA-62 | -Ph | —Cl |
| DA-63 | —Cl | —Cl |
| DA-64 | -Ph | -Ph |
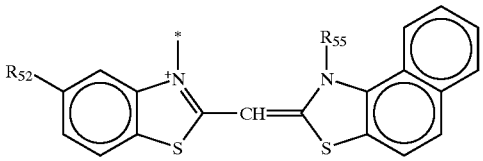
| | $R_{52}$ | $R_{55}$ |
|---|---|---|
| DA-65 | —Cl | —$CH_3$ |
| DA-66 | —Cl | —$C_2H_5$ |
| DA-67 | —$OCH_3$ | —$C_2H_5$ |
| DA-68 | -Ph | —$C_2H_5$ |
DA-69
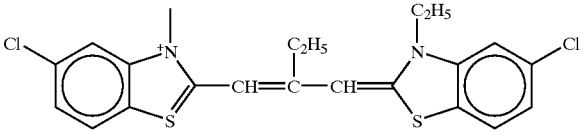

-continued

DA-70

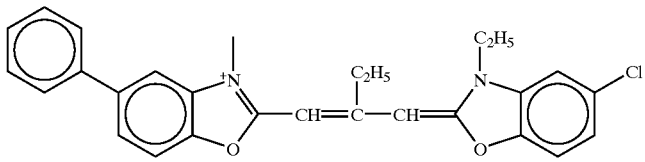

In the compound represented by formula (1) or (2), preferred examples of the merocyanine dye Dye2 having at least one dissociative group in the acidic nucleus are set forth below, however, the present invention is not limited thereto.

Examples of Dye2 Residue:

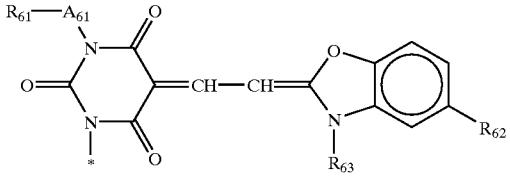

| | $R_{61}$ | $A_{61}$ | $R_{62}$ | $R_{63}$ |
|---|---|---|---|---|
| DB-1 | —$SO_3Na$ | —$(CH_2)_2$— | —$SO_3Na$ | —$C_2H_5$ |
| DB-2 | " | " | —H | —$(CH_2)_3$—$SO_3Na$ |
| DB-3 | " | " | " | —$CH_3$ |
| DB-4 | " | —$(CH_2)_3$— | —$SO_3Na$ | —$C_2H_5$ |
| DB-5 | " | 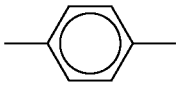 | " | " |
| DB-6 | —COOH | —$CH_2$— | " | " |
| DB-7 | —$PO_3Na_2$ | —$(CH_2)_2$— | —H | —$C_2H_5$ |
| DB-8 | —$OSO_3Na$ | —$(CH_2)_4$— | —$SO_3Na$ | —$(CH_2)_3$—$SO_3Na$ |

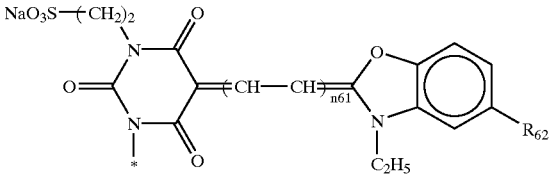

| | $n_{61}$ | $R_{62}$ |
|---|---|---|
| DB-9 | 2 | —$SO_3Na$ |
| DB-10 | 2 | —H |
| DB-11 | 3 | —$SO_3Na$ |

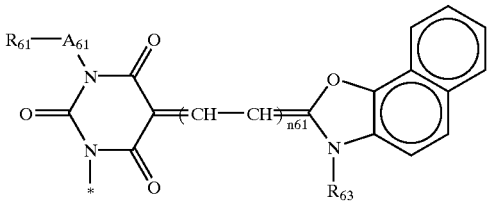

| | $R_{61}$ | $A_{61}$ | $n_{61}$ | $R_{63}$ |
|---|---|---|---|---|
| DB-12 | —$SO_3Na$ | —$(CH_2)_2$— | 1 | —$(CH_2)_4$—$SO_3Na$ |
| DB-13 | " | " | 1 | —$C_2H_5$ |

-continued
| | | | | |
|---|---|---|---|---|
| DB-14 | " | 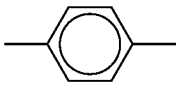 | 1 | $-(CH_2)_3-SO_3Na$ |
| DB-15 | —COOH | $—CH_2—$ | 1 | $-(CH_2)_2-SO_3K$ |
| DB-16 | $—PO_3K_2$ | $-(CH_2)_2-$ | 1 | $—CH_3$ |
| DB-17 | $—SO_3Na$ | $-(CH_2)_2-$ | 2 | $-(CH_2)_4-SO_3Na$ |
| DB-18 | " | " | 2 | $—C_2H_5$ |
DB-19
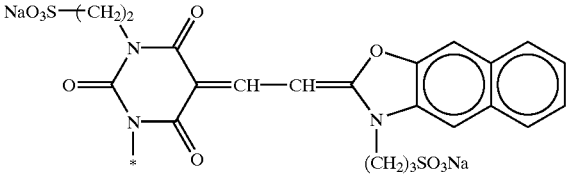
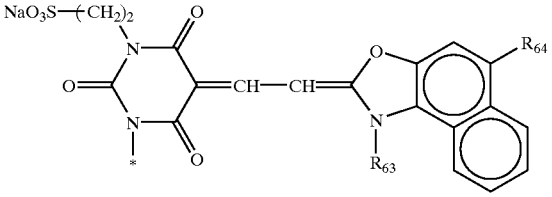
| | $R_{64}$ | $R_{63}$ |
|---|---|---|
| DB-20 | —H | $—CH_3$ |
| DB-21 | —H | $-(CH_2)_3-SO_3Na$ |
| DB-22 | $—SO_3Na$ | $—CH_3$ |
| DB-23 | " | $-(CH_2)_3-SO_3Na$ |
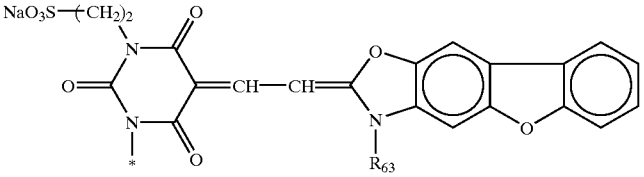
| | $R_{63}$ |
|---|---|
| DB-24 | $—C_2H_5$ |
| DB-25 | $-(CH_2)_3-SO_3Na$ |
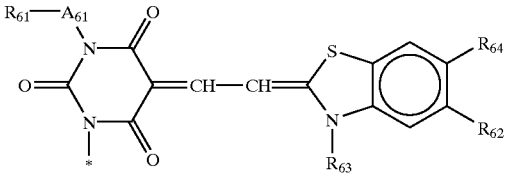
| | $R_{61}$ | $A_{61}$ | $R_{62}$ | $R_{64}$ | $R_{63}$ |
|---|---|---|---|---|---|
| DB-26 | $—SO_3Na$ | $-(CH_2)_2-$ | $—SO_3Na$ | —H | $—C_2H_5$ |
| DB-27 | " | " | —H | " | $—O-(CH_2)_3-SO_3Na$ |
| DB-28 | " | 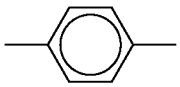 | " | " | $—O-(CH_2)_4-SO_3Na$ |
| DB-29 | $—SO_3K$ | $-(CH_2)_2-$ | " | $—O-(CH_2)_4-SO_3K$ | $—CH_3$ |
| DB-30 | $—PO_3Na_2$ | " | " | $—OPO_3Na_2$ | -Ph |

-continued
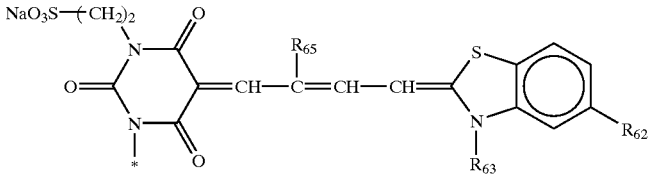
| | $R_{65}$ | $R_{62}$ | $R_{63}$ |
|---|---|---|---|
| DB-31 | —H | —$SO_3Na$ | —$C_2H_5$ |
| DB-32 | —$C_2H_5$ | " | " |
| DB-33 | " | —H | —$(CH_2)_3SO_3Na$ |
| DB-34 | " | " | —$C_2H_5$ |
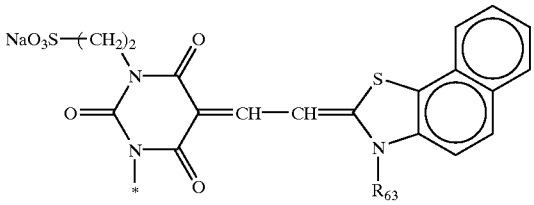
| | $R_{63}$ |
|---|---|
| DB-35 | —$C_2H_5$ |
| DB-36 | —$(CH_2)_3SO_3Na$ |
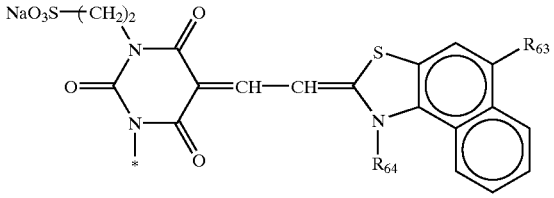
| | $R_{63}$ | $R_{64}$ |
|---|---|---|
| DB-37 | —$SO_3Na$ | —$CH_3$ |
| DB-38 | —H | —$CH_3$ |
| DB-39 | —H | —$(CH_2)_3SO_3Na$ |
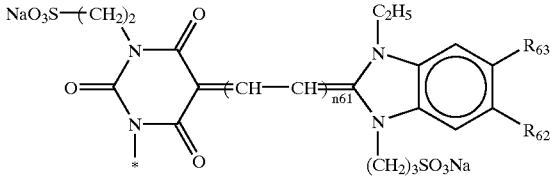
| | $n_{61}$ | $R_{62}$ | $R_{63}$ |
|---|---|---|---|
| DB-40 | 1 | —Cl | —Cl |
| DB-41 | 1 | —Cl | —CN |
| DB-42 | 1 | —Cl | —$CF_3$ |
| DB-43 | 1 | —$C_2H_5$ | —$C_2H_5$ |
| DB-44 | 2 | —Cl | —Cl |
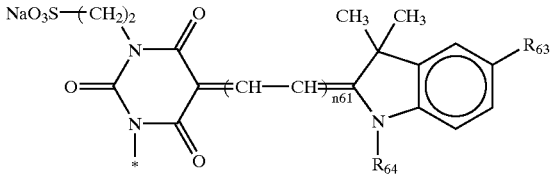
| | $n_{61}$ | $R_{63}$ | $R_{64}$ |
|---|---|---|---|
| DB-45 | 1 | —H | —$C_2H_5$ |

-continued
| | | | |
|---|---|---|---|
| DB-46 | 1 | —$SO_3Na$ | —$C_2H_5$ |
| DB-47 | 1 | —H | —$(CH_2)_3$—$SO_3Na$ |
| DB-48 | 2 | —$SO_3Na$ | —$C_2H_5$ |
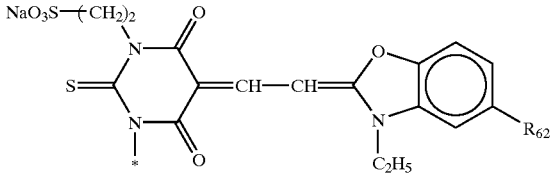
| | $R_{62}$ |
|---|---|
| DB-49 | —H |
| DB-50 | —$SO_3Na$ |
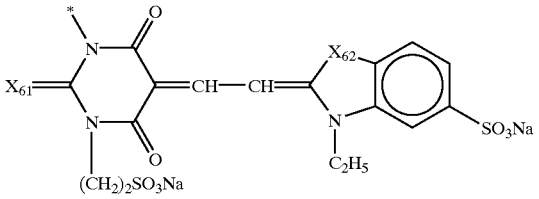
| | $X_{61}$ | $X_{62}$ |
|---|---|---|
| DB-51 | O | O |
| DB-52 | O | S |
| DB-53 | S | O |
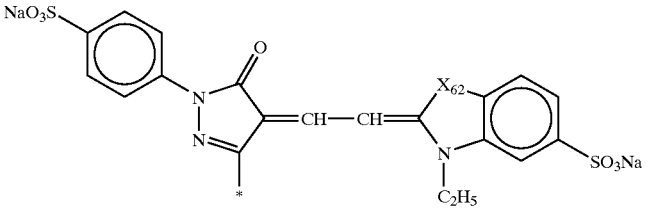
| | $X_{62}$ |
|---|---|
| DB-54 | O |
| DB-55 | S |
DB-56
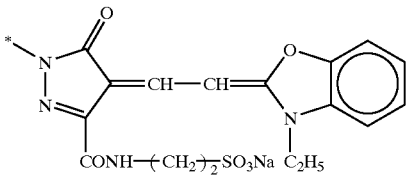
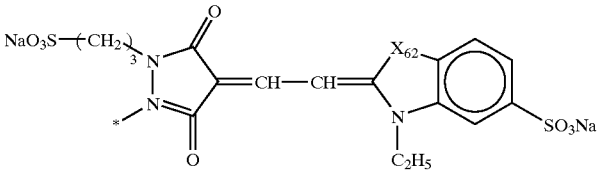
| | $X_{62}$ |
|---|---|
| DB-57 | O |
| DB-58 | S |

-continued
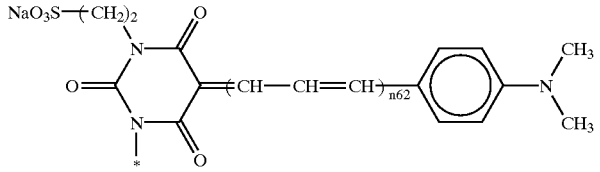
| | $n_{62}$ |
|---|---|
| DB-59 | 0 |
| DB-60 | 1 |
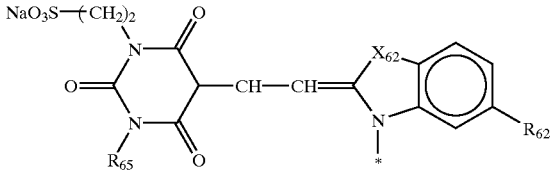
| | $R_{65}$ | $R_{62}$ | $X_{62}$ |
|---|---|---|---|
| DB-61 | $—C_2H_5$ | $—SO_3Na$ | O |
| DB-62 | " | —H | O |
| DB-63 | " | $—SO_3Na$ | S |
| DB-64 | $—(CH_2)_3—SO_3Na$ | —H | O |
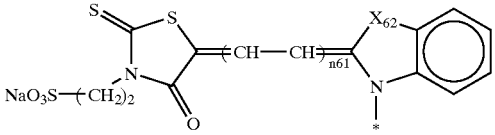
| | $n_{61}$ | $X_{62}$ |
|---|---|---|
| DB-65 | 0 | S |
| DB-66 | 1 | O |
| DB-67 | 1 | S |
| DB-68 | 2 | O |
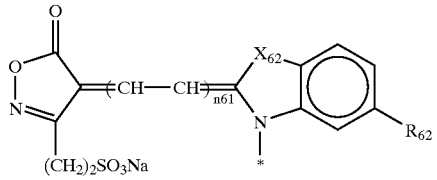
| | $n_{61}$ | $R_{62}$ | $X_{62}$ |
|---|---|---|---|
| DB-65 | 0 | $—SO_3Na$ | O |
| DB-66 | 1 | —H | O |
| DB-67 | 1 | $—SO_3Na$ | S |
| DB-68 | 2 | —H | O |
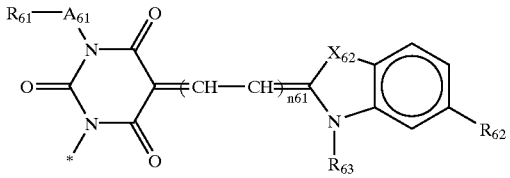
| | $R_{61}$ | $A_{61}$ | $n_{61}$ | $R_{62}$ | $R_{63}$ | $X_{62}$ |
|---|---|---|---|---|---|---|
| DB-69 | $—SO_3Na$ | 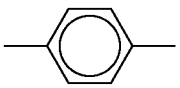 | 2 | $—SO_3Na$ | $—C_2H_5$ | —O— |
| DB-70 | " | " | 1 | $—SO_3^-$ | " | " |

-continued
| | | | | | | |
|---|---|---|---|---|---|---|
| DB-71 | " | 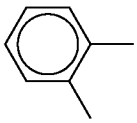 | " | —$SO_3Na$ | " | " |
| DB-72 | " | " | " | —$SO_3^-$ | " | " |
| DB-73 | " | " | " | —H | " | " |
| DB-74 | " | " | " | " | —$(CH_2)_3$—$SO_3Na$ | " |
| DB-75 | " | " | 2 | —$SO_3Na$ | —$C_2H_5$ | " |
| DB-76 | " | 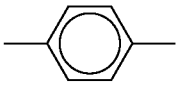 | 1 | " | " | —S— |
| DB-77 | " | " | 2 | " | " | " |
| DB-78 | " | 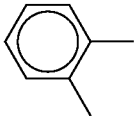 | 1 | " | " | " |
| DB-79 | " | " | 2 | " | " | " |
| DB-80 | " | " | 1 | —H | —$(CH_2)_3$—$SO_3Na$ | —$C(CH_3)_2$ |
| DB-81 | " | " | " | " | " | —$NC_2H_5$ |
| DB-82 | —COOH | " | " | —$SO_3Na$ | —$C_2H_5$ | —O— |
| DB-83 | —$PO_3Na_2$ | " | " | " | " | " |
| DB-84 | " | 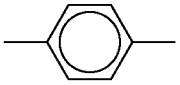 | " | " | " | " |
| D8-85 | —$OSO_3Na$ | 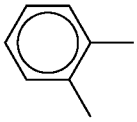 | " | " | " | " |
| DB-86 | —$SO_3Na$ | 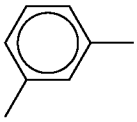 | " | " | " | " |
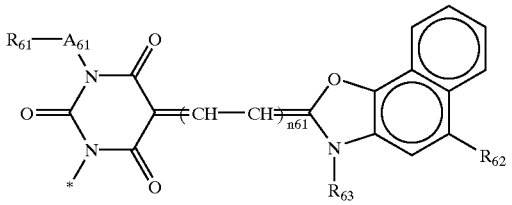
| | $R_{61}$ | $A_{61}$ | $n_{61}$ | $R_{62}$ | $R_{63}$ |
|---|---|---|---|---|---|
| DB-87 | —$SO_3Na$ | 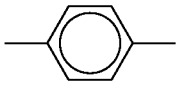 | 1 | —$SO_3Na$ | —$C_2H_5$ |
| DB-88 | " | " | 2 | " | " |
| DB-89 | " | 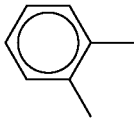 | 1 | " | " |
| DB-90 | " | " | " | —$SO_3^-$ | " |

-continued

| | | | | | |
|---|---|---|---|---|---|
| DB-91 | " | " | " | —H | " |
| DB-92 | " | " | " | " | $-(CH_2)_4-SO_3Na$ |
| DB-93 | $—PO_3Na_2$ | " | " | $—SO_3Na$ | $—C_2H_5$ |
| DB-94 | $—SO_3Na$ | " | 2 | " | " |

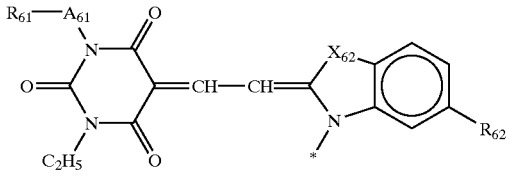

| | $R_{61}$ | $A_{61}$ | $R_{62}$ | $X_{62}$ |
|---|---|---|---|---|
| DB-95 | $—SO_3Na$ | | $—SO_3Na$ | —O— |
| DB-96 | " | | " | " |
| DB-97 | " | " | —H | " |
| DB-98 | " | " | $—SO_3Na$ | —S— |

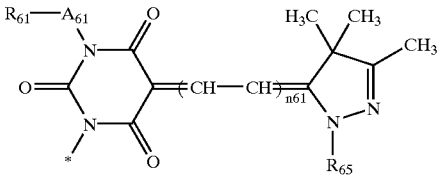

| | $R_{61}$ | $A_{61}$ | $n_{61}$ | $R_{65}$ |
|---|---|---|---|---|
| DB-99 | $—SO_3Na$ | | 1 | $-(CH_2)_3-SO_3Na$ |
| DB-100 | " | " | " | $—C_2H_5$ |
| DB-101 | " | | " | $-(CH_2)_3-SO_3Na$ |
| DB-102 | " | " | " | $-(CH_2)_3-SO_3^-$ |
| DB-103 | " | " | " | $—C_2H_5$ |
| DB-104 | " | " | 2 | $-(CH_2)_3-SO_3Na$ |

In the compound represented by formula (1) or (2) of the present invention, preferred examples of the linking group $-L_1-$ are set forth below, however, the present invention is not limited thereto.

Examples of Linking Chain $-L_1-$ (Dye1 in the Left)

| | |
|---|---|
| L-1 | $-(CH_2)_4-$ |
| L-2 | $-(CH_2)_8-$ |
| L-3 | $-(CH_2)_7-CH=CH-(CH_2)_7-$ |

-continued
L-4
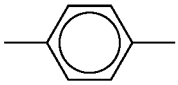
L-5
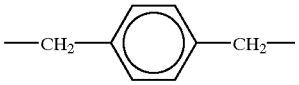
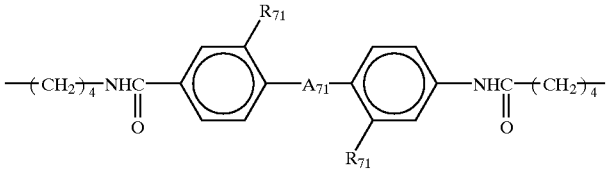
| | $A_{71}$ | $R_{71}$ |
|---|---|---|
| L-6 | — | H |
| L-7 | — | $-SO_3^-.\overset{+}{H}NEt(i\text{-}Pr)_2$ |
| L-8 | —O— | H |
| L-9 | —O— | $—SO_3Na$ |
| L-10 | $—SO_2—$ | H |
L-11
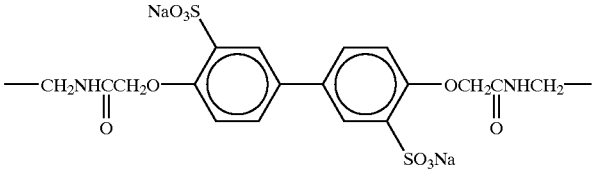
L-12
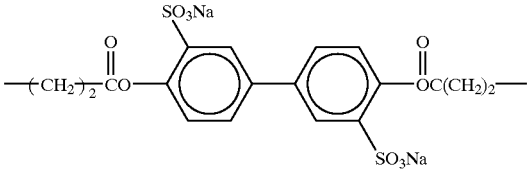
L-13
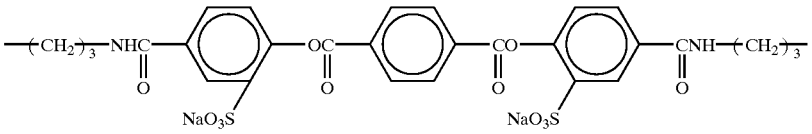
L-14
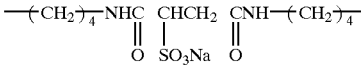
L-15
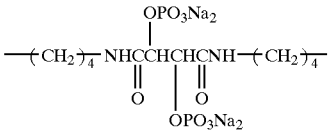
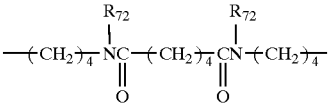
| | $R_{72}$ |
|---|---|
| L-16 | $-(CH_2)_3-SO_3Na$ |
| L-17 | $-(CH_2)_2-COONa$ |
| L-18 | $-(CH_2)_2-PO_3Na_2$ |

-continued
L-19
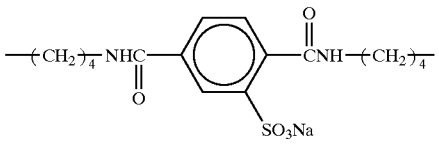
$-(CH_2)_{n71}-NHC(=O)-(CH_2)_{n72}-$
| | $n_{71}$ | $n_{72}$ |
|---|---|---|
| L-20 | 4 | 5 |
| L-21 | 8 | 5 |
| L-22 | 8 | 1 |
| L-23 | 4 | 3 |
| L-24 | 4 | 1 |
L-25
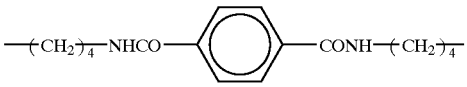
L-26 $-(CH_2)_4-NHCO-(CH_2)_2-CONH-(CH_2)_4-$
$-(CH_2)_{n73}-CNH(=O)-(CH_2)_{n74}-$
| | $n_{73}$ | $n_{74}$ |
|---|---|---|
| L-27 | 5 | 4 |
| L-28 | 5 | 8 |
| L-29 | 1 | 6 |
L-30 $-(CH_2)_6-OC(=O)-(CH_2)_5-$
L-31 $-(CH_2)_5-CO(=O)-(CH_2)_6-$
L-32 $-(CH_2)_8-NHSO_2-(CH_2)_3-$
$-(CH_2)_2-(OCH_2CH_2)_{n75}-NHC(=O)-(CH_2)_{n76}-$
| | $n_{75}$ | $n_{76}$ |
|---|---|---|
| L-33 | 2 | 5 |
| L-34 | 2 | 1 |
| L-35 | 3 | 1 |
$-(CH_2)_2-(OCH_2CH_2)_{n77}-CNH(=O)-(CH_2)_{n78}-$
| | $n_{77}$ | $n_{78}$ |
|---|---|---|
| L-36 | 2 | 3 |
| L-37 | 2 | 4 |
| L-38 | 2 | 8 |
L-39 $-(CH_2)_3-CNH(=O)-(CH_2)_2-(OCH_2CH_2)_2-CONH-(CH_2)_3-$
L-40 $-(CH_2)_4-NHC(=O)-(CH_2CH_2O)_2-(CH_2)_2-$ -continued

| | |
|---|---|
| L-41 | $-(CH_2)_5-\underset{\underset{O}{\parallel}}{C}-NH-(CH_2CH_2O)_2-(CH_2)_2-$ |
| L-42 | $-(CH_2)_2-(OCH_2CH_2)_2-O\overset{\overset{O}{\parallel}}{C}-(CH_2)_5-$ |
| L-43 | $-(CH_2)_2-(OCH_2CH_2)_2-NHSO_2-(CH_2)_3-$ |

$-(CH_2)_2-(A_{72}CH_2CH_2)_2-NHCO-(CH_2)_5-$

| | $A_{72}$ |
|---|---|
| L-44 | —S— |
| L-45 | $-N(CH_3)-$ |
| L-46 | $-CH(OH)-$ |

| | |
|---|---|
| L-47 | $-(CH_2)_2-SO_2-(CH_2)_2-NHCO-(CH_2)_5-$ |
| L-48 | $-(CH_2)_2-(OCH_2CH_2)_2-NHCO-C_6H_4-$ |

Specific examples of the compound represented by formula (1) or (2) of the present invention are set forth below, however, the present invention is not limited thereto.

Examples of Compound Dye1 -$L_1$-Dye2 of the Present Invention:

| | Dye 1 | -$L_1$- | Dye 2 |
|---|---|---|---|
| D-1 | DA-11 | L-2 | DB-12 |
| D-2 | " | L-7 | " |
| D-3 | " | L-14 | " |
| D-4 | " | L-16 | " |
| D-5 | " | L-22 | " |
| D-6 | " | L-27 | " |
| D-7 | " | L-30 | " |
| D-8 | " | L-32 | " |
| D-9 | " | L-34 | " |
| D-10 | " | L-37 | " |
| D-11 | " | L-41 | " |
| D-12 | " | L-43 | " |
| D-13 | " | L-47 | " |
| D-14 | " | L-22 | DB-1 |
| D-15 | " | L-34 | " |
| D-16 | " | L-22 | DB-5 |
| D-17 | " | L-22 | DB-13 |
| D-18 | " | L-34 | " |
| D-19 | " | " | DB-22 |
| D-20 | " | " | DB-25 |
| D-21 | " | " | DB-26 |
| D-22 | " | " | DB-27 |
| D-23 | " | " | DB-40 |
| D-24 | " | L-22 | DB-46 |
| D-25 | " | L-34 | DB-50 |
| D-26 | " | " | DB-51 |
| D-27 | " | " | DB-54 |
| D-28 | " | " | DB-57 |
| D-29 | " | " | DB-59 |
| D-30 | " | L-33 | DB-61 |
| D-31 | DA-11 | L-33 | DB-66 |
| D-32 | " | " | DB-69 |
| D-33 | " | L-34 | DB-65 |

-continued

| | Dye 1 | -$L_1$- | Dye 2 |
|---|---|---|---|
| D-34 | DA-1 | L-34 | DB-1 |
| D-35 | " | L-22 | DB-3 |
| D-36 | " | L-34 | DB-12 |
| D-37 | " | L-22 | DB-13 |
| D-38 | DA-2 | L-22 | DB-12 |
| D-39 | DA-3 | L-34 | " |
| D-40 | DA-9 | L-34 | DB-1 |
| D-41 | " | L-22 | DB-3 |
| D-42 | " | L-34 | DB-12 |
| D-43 | " | L-22 | DB-13 |
| D-44 | DA-10 | L-34 | DB-12 |
| D-45 | DA-17 | L-34 | DB-32 |
| D-46 | DA-27 | " | DB-44 |
| D-47 | DA-35 | " | DB-9 |
| D-48 | DA-36 | " | DB-10 |
| D-49 | DA-37 | " | DB-9 |
| D-50 | DA-38 | " | DB-17 |
| D-51 | DA-39 | " | DB-46 |
| D-52 | DA-45 | L-33 | DB-1 |
| D-53 | DA-53 | L-36 | DB-12 |
| D-54 | DA-55 | L-35 | " |
| D-55 | DA-58 | L-38 | " |
| D-56 | DA-60 | L-37 | DB-17 |
| D-57 | DA-11 | L-34 | DB-5 |
| D-58 | " | " | DB-14 |
| D-59 | DA-11 | L-33 | DB-5 |
| D-60 | " | L-21 | " |
| D-61 | " | L-33 | DB-71 |
| D-62 | " | L-21 | " |
| D-63 | " | L-34 | DB-78 |
| D-64 | " | L-22 | DB-84 |
| D-65 | " | L-34 | DB-86 |
| D-66 | " | L-33 | DB-87 |
| D-67 | " | L-21 | " |
| D-68 | " | L-33 | DB-89 |
| D-69 | " | L-21 | " |
| D-70 | " | L-33 | DB-92 |
| D-71 | " | " | DB-96 |
| D-72 | " | " | DB-99 |

-continued

| | Dye 1 | $-L_1-$ | Dye 2 |
|---|---|---|---|
| D-73 | " | " | DB-101 |
| D-74 | " | L-21 | " |
| D-75 | " | L-33 | DB-103 |
| D-76 | " | L-21 | " |
| D-77 | DA-1 | L-33 | DB-71 |
| D-78 | " | " | DB-89 |
| D-79 | " | " | DB-103 |
| D-80 | DA-9 | " | DB-71 |
| D-81 | " | " | DB-89 |
| D-82 | " | " | DB-103 |
| D-83 | DA-17 | L-34 | DB-79 |
| D-84 | DA-35 | " | DB-75 |
| D-85 | DA-68 | L-33 | DB-70 |
| D-86 | " | " | DB-72 |
| D-87 | " | " | DB-90 |
| D-88 | " | " | DB-102 |
| D-89 | DA-65 | " | DB-72 |
| D-90 | " | " | DB-102 |
| D-91 | DA-62 | " | DB-72 |
| D-92 | " | " | DB-102 |

The compounds of the present invention can be synthesized according to the methods described, for example, in F. M. Harmer, *Heterocyclic Compounds—Cyanine Dyes and Related Compounds*, John Wiley & Sons, New York, London (1964), D. M. Sturmer, *Heterocyclic Compounds—Special topics in heterocyclic chemistry*, Chap. 18, Section 14, pp. 482–515, John & Wiley & Sons, New York, London (1977), and European Patent 887700A1.

In the compound represented by formula (1) or (2), the adsorption strength to a silver halide grain is preferably Dye1>Dye2.

The adsorptivity to a silver halide grain can be determined using respective model compounds.

When Dye2 of the compound represented by formula (1) or (2) is photo-excited, the Dye2 preferably undertakes electron transfer or energy transfer to Dye1.

Furthermore, in a silver halide photographic emulsion or a silver halide photographic material, when the compound represented by formula (1) or (2) is adsorbed to a silver halide grain through Dye1 and the Dye2 not adsorbed to the silver halide grain is photo-exited, the Dye2 preferably undertakes electron transfer or energy transfer to Dye1.

Also, in a silver halide photographic emulsion or a silver halide photographic material, the compound represented by formula (1) or (2) preferably adsorbs to a silver halide grain through Dye1 to form a J-aggregate.

In the compound represented by formula (1), the adsorption strength to a silver halide grain is preferably Dye1>Dye2. In view of this point, Dye2 must contain one or more of $—SO_3M$, $—OSO_3M$, $—OPO_3M_2$, $—PO_3M_2$ and —COOM, more preferably at least one $—SO_3M$. M represents proton or cation.

The adsorptivity to a silver halide grain can be determined using respective model compounds.

The silver halide photographic light-sensitive material of the present invention is described in detail below.

The compound of the present invention is used mainly as a sensitizing dye in a silver halide photographic emulsion or in a silver halide photographic light-sensitive material.

In the silver halide photographic emulsion or in the silver halide light-sensitive material, the compounds of the present invention may be used individually or in combination of two or more thereof or may be used in combination with another sensitizing dye. Preferred examples of the dye used here include cyanine dyes, merocyanine dyes, rhodacyanine dyes, trinuclear merocyanine dyes, tetranuclear merocyanine dyes, allopolar dyes, hemicyanine dyes and styryl dyes. Among these, preferred are cyanine dyes, merocyanine dyes and rhodacyanine dyes, more preferred are cyanine dyes. These dyes are described in detail in F. M. Harmer, *Heterocyclic Compounds—Cyanine Dyes and Related Compounds*, John Wiley & Sons, New York, London (1964), D. M. Sturmer, *Heterocyclic Compounds—Special topics in heterocyclic chemistry*, Chap. 18, Section 14, pp. 482–515, and *Rodd's Chemistry of Carbon Compounds,* 2nd Ed., Vol. IV, Part B, Chap. 15, pp. 369–422, John Wiley & Sons, New York, London (1977), Elsevier Science Publishing Company Inc., New York.

Preferred examples of the dye include the sensitizing dyes represented by the formulae or described as specific examples in U.S. Pat. No. 5,994,051, pp. 32–44, and U.S. Pat. No. 5,747,236, pp. 30–39.

Also, preferred examples of the cyanine dye, the merocyanine dye and the rhodacyanine dye include those represented by formulae (XI), (XII) and (XIII) of U.S. Pat. No. 5,340,694, columns 21 to 22 (on the condition that the numbers of n12, n15, n17 and n18 are not limited and each is an integer of 0 or more (preferably 4 or less)).

These sensitizing dyes may be used individually or in combination of two or more thereof. The combination of sensitizing dyes is often used for the purpose of supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,303,377, 3,769,301, 3,814,609, 3,837,862 and 4,026,707, British Patents 1,344,281 and 1,507,803, JP-B-43-4936 (the term "JP-B" as used herein means an "examined Japanese patent publication"), JP-B-53-12375, JP-A-52-110618 and JP-A-52-109925.

Together with the sensitizing dye, a dye which itself has no spectral sensitizing effect or a substance which absorbs substantially no visible light, but which brings supersensitization, can also be contained in the emulsion.

The supersensitizer (e.g., pyrimidylamino compound, triazinylamino compound, azolium compound, aminostyryl compound, aromatic organic acid formaldehyde condensate, azaindene compound, cadmium salt) and the combination of a supersensitizer and a sensitizing dye, which are useful in the spectral sensitization of the present invention, are described, for example, in U.S. Pat. Nos. 3,511,664, 3,615,613, 3,615,632, 3,615,641, 4,596,767, 4,945,038, 4,965,182, 2,933,390, 3,635,721, 3,743,510 and 3,617,295. With respect to the use method thereof, the methods described in these patents are preferred.

The timing of adding the sensitizing dyes for use in the present invention (the same applies to other sensitizing dyes and supersensitizers) to the silver halide emulsion of the present invention may be at any stage heretofore recognized as useful in the preparation of the emulsion. The sensitizing dye may be added at any time or in any step insofar as the addition is performed before the coating of emulsion, for example, the sensitizing dye may be added before formation of silver halide grains and/or before desalting, or during desalting and/or between after desalting and before initiation of chemical ripening, as disclosed in U.S. Pat. Nos. 2,735,766, 3,628,960, 4,183,756 and 4,225,666, JP-A-58-184142 and JP-A-60-196749, or may be added immediately before or during chemical ripening, or between after chemical ripening and before coating as disclosed in JP-A-58-113920. Also, as disclosed in U.S. Pat. No. 4,225,666 and JP-A-58-7629, a compound by itself or in combination with another compound having a foreign structure may be added in parts, for example, during the grain formation and during the chemical ripening or after the completion of chemical ripening, or before or during the chemical ripening and after the completion of chemical ripening. The kind of the compound added in parts and the combination of compounds may also be varied.

The amount added of the sensitizing dye for use in the present invention (the same applies to other sensitizing dyes and supersensitizers) varies depending on the shape and size of silver halide grains and although the sensitizing dye may be added in any amount, the sensitizing dye is preferably used in an amount of $1\times10^{-8}$ to $8\times10^{-1}$ mol per mol of silver halide. For example, when the silver halide grain size is 0.2 to 1.3 $\mu$m, the amount added is preferably from $2\times10^{-6}$ to $3.5\times10^{-3}$ mol, more preferably from $7.5\times10^{-6}$ to $1.5\times10^{-3}$ mol, per mol of silver halide.

The sensitizing dye of the present invention (the same applies to other sensitizing dyes and super-sensitizers) can be dispersed directly in an emulsion. The sensitizing dye may also be dissolved in an appropriate solvent such as methyl alcohol, ethyl alcohol, methyl cellosolve, acetone, water, pyridine or a mixed solvent thereof and then added in the form of a solution to an emulsion. At this time, additives such as base, acid and surfactant may also be allowed to be present together. Furthermore, an ultrasonic wave may also be used for the dissolution. With respect to the method for adding the compound, the following methods may be used: a method described in U.S. Pat. No. 3,469,987, where the compound is dissolved in a volatile organic solvent, the obtained solution is dispersed in hydrophilic colloid and the obtained dispersion is added to emulsion; a method described in JP-B-46-24185, where the compound is dispersed in a water-soluble solvent and the obtained dispersion is added to emulsion; a method described in U.S. Pat. No. 3,822,135, where the compound is dissolved in a surfactant and the obtained solution is added to emulsion; a method described in JP-A-51-74624, where the compound is dissolved using a compound capable of red-shifting and the obtained solution is added to emulsion; and a method described in JP-A-50-80826, where the compound is dissolved in an acid substantially free of water and the obtained solution is added to emulsion. In addition, for the addition to emulsion, the methods described in U.S. Pat. Nos. 2,912,343, 3,342,605, 2,996,287 and 3,429,835 may be used.

In the present invention, for the photographic emulsion undertaking the photosensitive mechanism, any of silver bromide, silver iodobromide, silver chlorobromide, silver iodide, silver iodochloride, silver iodobromo-chloride and silver chloride may be used. However, the halogen composition on the outermost surface of emulsion preferably has an iodide content of 0.1 mol % or more, more preferably 1 mol % or more, still more preferably 5 mol % or more, whereby the multilayer adsorption structure can be more firmly constructed.

The grain size distribution may be either broad or narrow but narrow distribution is preferred.

The silver halide grain of the photographic emulsion may be a grain having a regular crystal form such as cubic, octahedral, tetradecahedral or rhombic dodecahedral form, a grain having an irregular crystal form such as spherical or tabular form, a grain having an hkl face, or a mixture of grains having these crystal forms, however, a tabular grain is preferred. The tabular grain is described in detail later. The grain having an hkl face is described in *Journal of Imaging Science*, Vol. 30, pp. 247–254 (1986).

The silver halide photographic emulsion for use in the present invention may contain the above-described silver halide grains individually or may contain a plurality of the grains in mixture. The silver halide grain may have different phases between the interior and the surface layer, may have a multi-phase structure, for example, with a junction structure, may have a localized phase on the grain surface or may have a uniform phase throughout the grain. Also, these grains may be present in mixture.

These various emulsions each may be either a surface latent image-type emulsion in which a latent image is mainly formed on the surface, or an internal latent image-type emulsion in which a latent image is formed inside the grain.

In the present invention, a silver halide tabular grain having a halogen composition of silver chloride, silver bromide, silver chlorobromide, silver iodobromide, silver chloroiodobromide or silver iodochloride is preferably used. The tabular grain preferably has a main surface of (100) or (111). The tabular grain having a (111) main surface is hereinafter referred to as a (111) tabular grain and this grain usually has a triangular or hexangular face. In general, as the distribution is more uniform, the ratio of tabular grains having a hexangular face is higher. As for the monodisperse hexangular tabular grain, JP-B-5-61205 describes this grain.

The tabular grain having a (100) face as the main surface is hereinafter called a (100) tabular grain and this grain has a rectangular or square form. In the case of this emulsion, a grain having a ratio of adjacent sides of less than 5:1 is called a tabular grain rather than an acicular grain. In the case of a silver chloride tabular grain or a grain rich in silver chloride, the (100) tabular grain is higher in the stability of the main surface than that of the (111) tabular grain. Therefore, the (111) tabular grain must be subjected to stabilization of the (111) main surface and the method therefor is described in JP-A-9-80660, JP-A-9-80656 and U.S. Pat. No. 5,298,388.

The (111) tabular grain comprising silver chloride or having a high silver chloride content, which is used in the present invention, is disclosed in the following patents:

U.S. Pat. Nos., 4,414,306, 4,400,463, 4,713,323, 4,783,398, 4,962,491, 4,983,508, 4,804,621, 5,389,509, 5,217,858 and 5,460,934.

The high silver bromide (111) tabular grain for use in the present invention is described in the following patents:

U.S. Pat. Nos. 4,425,425, 4,425,426, 4,434,226, 4,439,520, 4,414,310, 4,433,048, 4,647,528, 4,665,012, 4,672,027, 4,678,745, 4,684,607, 4,593,964, 4,722,886, 4,755,617, 4,755,456, 4,806,461, 4,801,522, 4,835,322, 4,839,268, 4,914,014, 4,962,015, 4,977,074, 4,985,350, 5,061,609, 5,061,616, 5,068,173, 5,132,203, 5,272,048, 5,334,469, 5,334,495, 5,358,840 and 5,372,927.

The (100) tabular grain for use in the present invention is described in the following patents:

U.S. Pat. Nos. 4,386,156, 5,275,930, 5,292,632, 5,314,798, 5,320,938, 5,319,635 and 5,356,764, European Patents 569,971 and 737,887, JP-A-6-308648 and JP-A-9-5911.

The silver halide emulsion for use in the present invention is preferably a silver halide tabular grain having a higher surface area/volume ratio and having adsorbed thereto a sensitizing dye disclosed in the present invention. The aspect ratio is preferably 2 or more, more preferably 5 or more, still more preferably 8 or more. The upper limit is not particularly limited but is preferably 1,000 or less, more preferably 500 or less. The thickness of the tabular grain is preferably less than 0.2 $\mu$m, more preferably less than 0.1 $\mu$m, still more preferably less than 0.07 $\mu$m.

The term "the aspect ratio is 2 or more" as used herein means that silver halide grains having an aspect ratio (equivalent-circle diameter/grain thickness of a silver halide grain) of 2 or more occupies 50% or more, preferably 70% or more, more preferably 85% or more, of the projected area of all silver halide grains in the emulsion.

In order to prepare thin tabular grains having such a high aspect ratio, the following technique is applied.

The tabular grain preferably has a uniform dislocation line amount distribution among grains. In the emulsion for use in the present invention, silver halide grains having 10 or more dislocation lines per one grain preferably occupy from 50 to 100% (by number), more preferably from 70 to 100%, still more preferably from 90 to 100%, of all grains. If the percentage occupied is less than 50%, the homogeneity among grains is adversely affected.

In the present invention, for determining the ratio of grains containing a dislocation line and the number of dislocation lines, it is preferred to directly observe the dislocation lines of at least 100 grains, more preferably 200 grains or more, more preferably 300 grains or more.

Gelatin is advantageous as a protective colloid used in the preparation of an emulsion or as a binder for other hydrophilic colloid layers. However, other hydrophilic colloids may also be used.

Examples of other hydrophilic colloids which can be used include proteins such as gelatin derivatives, graft polymers of gelatin with other polymer, albumin and casein; cellulose derivatives such as hydroxyethyl cellulose, carboxymethyl cellulose and cellulose sulfates; sugar derivatives such as sodium alginate and starch derivatives; and various synthetic hydrophilic polymer materials such as homopolymers and copolymers, for example, polyvinyl alcohol, polyvinyl alcohol partial acetal, poly-N-vinylpyrrolidone, polyacrylic acid, polymethacrylic acid, polyacrylamide, polyvinylimidazole and polyvinylpyrazole.

Examples of the gelatin which can be used include lime-treated gelatin, acid-treated gelatin and enzyme-treated gelatin described in *Bull. Soc. Sci. Photo. Japan.*, No. 16, page 30 (1966). Furthermore, hydrolysates and enzyme-decomposed product of gelatin can also be used.

The emulsion is preferably washed with water for desalting and dispersed in a newly prepared protective colloid. The temperature at the water washing may be selected according to the purpose but is preferably selected from the range of 5 to 50° C. The pH at the water washing may also be selected according to the purpose but is preferably selected from the range of 2 to 10, more preferably from 3 to 8. The pAg at the water washing may also be selected according to the purpose but is preferably selected from the range of 5 to 10. The method for performing water washing may be selected from a noodle washing method, a dialysis method using a semipermeable membrane, a centrifugal separation method, a coagulating precipitation method and an ion exchange method. In the case of coagulating precipitation, a method using a sulfate, a method using an organic solvent, a method using a water-soluble polymer or a method using a gelatin derivative may be selected.

According to the purpose, a salt of metal ion is preferably allowed to be present at the time of preparing the emulsion, for example, during grain formation, desalting or chemical sensitization, or before coating. The metal ion salt is preferably added during grain formation in the case of doping it into a grain and is preferably added after grain formation but before completion of chemical sensitization in the case of using the metal ion salt for the modification of the grain surface or as a chemical sensitizer. The metal ion salt may be doped throughout the grain or may be doped only into the core part or only into the shell part. Examples of the metal which can be used include Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb and Bi. This metal can be added when it is in the form of a salt capable of dissolving at the time of grain formation, such as ammonium salt, acetate, nitrate, sulfate, phosphate, hydroxide, six-coordinated complex salt or four-coordinated complex salt. Examples of the metal ion salt include $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, $K_4Ru(CN)_6$. The ligand of the coordination compound can be selected from halo, aquo, cyano, cyanate, thiocyanate, nitrosyl, thionitrosyl, oxo and carbonyl. Only one of these metal compounds may be used but two or more thereof may also be used in combination.

The metal compound is preferably added after dissolving it in water or an appropriate organic solvent such as methanol or acetone. In order to stabilize the solution, a method of adding an aqueous solution of hydrogen halide (e.g., HCl, HBr) or an alkali halide (e.g., KCl, NaCl, KBr, NaBr) may be used. If desired, an acid or an alkali may also be added. The metal compound may be added to the reactor either before or during the grain formation. It is also possible to add the metal compound to an aqueous solution of water-soluble silver salt (e.g., $AgNO_3$) or alkali halide (e.g., NaCl, KBr, KI) and continuously add the solution during the formation of silver halide grains. Furthermore, the solution may be prepared independently of the water-soluble silver salt and the alkali halide and then continuously added in an appropriate timing during the grain formation. A combination use of various addition methods is also preferably used.

In some cases, the method of adding a chalcogen compound during the preparation of an emulsion described in U.S. Pat. No. 3,772,031 is also useful. A cyanate, a thiocyanate, a selenocyanate, a carbonate, a phosphate or an acetate may also be allowed to be present other than S, Se and Te.

The silver halide grain may be subjected to at least one of sulfur sensitization, selenium sensitization, gold sensitization, palladium sensitization, noble metal sensitization and reduction sensitization, at any step in the process of preparing the silver halide emulsion. A combination use of two or more sensitization methods is preferred. By varying the step of performing the chemical sensitization, various types of emulsions may be prepared, more specifically, a type where a chemical sensitization speck is embedded inside the grain, a type where a chemical sensitization speck is embedded in the shallow part from the grain surface, and a type where a chemical sensitization speck is formed on the grain surface. In the emulsion for use in the present invention, the site of chemical sensitization speck can be selected according to the purpose, however, in general, at least one kind of chemical sensitization speck is preferably formed in the vicinity of the surface.

The chemical sensitization which can be preferably performed in the present invention is chalcogen sensitization, noble metal sensitization or a combination thereof. As described in T. H. James, *The Theory of the Photographic Process,* 4th ed., Macmillan, pp. 67–76 (1977), the chemical sensitization may be performed using active gelatin. Furthermore, as described in *Research Disclosure*, Vol. 120, 12008 (April, 1974), *Research Disclosure*, Vol. 34, 13452 (June, 1975), U.S. Pat. Nos. 2,642,361, 3,297,446, 3,772,031, 3,857,711, 3,901,714, 4,266,018 and 3,904,415 and British Patent 1,315,755, the chemical sensitization may be performed using sulfur, selenium, tellurium, gold, platinum, palladium, iridium or a combination of two or more of these sensitizing dyes at a pAg of 5 to 10, a pH of 5 to 8 and a temperature of 30 to 80° C. In the noble metal sensitization, a noble metal salt such as gold, platinum, palladium or iridium may be used and particularly, gold sensitization, palladium sensitization and a combination thereof are preferred. In the case of gold sensitization, a known compound such as chloroauric acid, potassium chloroaurate, potassium aurithiocyanate, gold sulfide or gold selenide may be used. The palladium compound means a palladium divalent or tetravalent salt. The palladium compound is preferably represented by $R_2PdX_6$ or $R_2PdX_4$, wherein R represents a hydrogen atom, an alkali metal atom or an ammonium group and X represents a halogen atom such as chlorine, bromine or iodine.

More specifically, $K_2PdCl_4$, $(NH_4)_2PdCl_6$, $Na_2PdCl_4$, $(NH_4)_2PdCl_4$, $Li_2PdCl_4$, $Na_2PdCl_6$ and $K_2PdBr_4$ are preferred. The gold compound and the palladium compound each is preferably used in combination with a thiocyanate or a selenocyanate.

Examples of the sulfur sensitizer which can be used include hypo, thiourea-based compounds, rhodanine-based compounds and sulfur-containing compounds described in U.S. Pat. Nos. 3,857,711, 4,266,018 and 4,054,457. The chemical sensitization may also be performed in the presence of a so-called chemical sensitization aid. Useful chemical sensitization aids are compounds known to suppress fogging and at the same time, elevate the sensitivity in the process of chemical sensitization, such as azaindene, azapyridazine and azapyrimidine. Examples of the chemical sensitization aid modifier are described in U.S. Pat. Nos. 2,131,038, 3,411,914 and 3,554,757, JP-A-58-126526 and Duffin, *Shashin Nyuzai Kagaku* (*Photographic Emulsion Chemistry*), supra, pp. 138–143.

In the chemical sensitization of emulsion, gold sensitization is preferably used in combination. The amount of the gold sensitizer is preferably from $1\times10^{-7}$ to $1\times10^{-4}$ mol, more preferably from $5\times10^{-7}$ to $1\times10^{-5}$ mol, per mol of silver halide. The amount of the palladium compound is preferably from $5\times10^{-7}$ to $1\times10^{-3}$ mol per mol of silver halide. The amount of the thiocyanate compound or selenocyanate compound is preferably from $1\times10^{-6}$ to $5\times10^{-2}$ mol per mol of silver halide.

The amount of the sulfur sensitizer used for the silver halide grain of the present invention is preferably from $1\times10^{-7}$ to $1\times10^{-4}$, more preferably from $5\times10^{-7}$ to $1\times10^{-5}$ mol, per mol of silver halide.

The preferred sensitization method for the emulsion of the present invention includes selenium sensitization. In the selenium sensitization, a known labile selenium compound is used and specific examples of the selenium compound which can be used include colloidal metal selenium, selenoureas (e.g., N,N-dimethylselenourea, N,N-diethylselenourea), selenoketones and selenoamides. In some cases, the selenium sensitization is preferably performed in combination with one or both of sulfur sensitization and noble metal sensitization.

The silver halide emulsion is preferably subjected to reduction sensitization during grain formation, before or during chemical sensitization after grain formation, or after chemical sensitization.

For the reduction sensitization, a method of adding a reduction sensitizer to the silver halide emulsion, a method called silver ripening where the emulsion is grown or ripened in a low pAg atmosphere at a pAg of 1 to 7, or a method called high pH ripening where the emulsion is grown or ripened in a high pH atmosphere at a pH of 8 to 11 may be selected. Also, two or more of these methods may be used in combination. The method of adding a reduction sensitizer is preferred because the reduction sensitization level can be delicately controlled.

Known examples of the reduction sensitizer include stannous chloride, ascorbic acid and its derivatives, amines and polyamines, hydrazine derivatives, formamidine-sulfinic acid, silane compounds and borane compounds. In the present invention, the reduction sensitization may be performed using a reduction sensitizer selected from these known reduction sensitizers, and two or more compounds may also be used in combination. Preferred compounds as the reduction sensitizer are stannous chloride, thiourea dioxide, dimethylamineborane, and ascorbic acid and its derivatives. The amount of the reduction sensitizer added depends on the conditions in the production of emulsion and therefore, must be selected but is suitably from $10^{-7}$ to $10^{-3}$ mol per mol of silver halide.

The reduction sensitizer is added during the grain growth after dissolving it in water or an organic solvent such as alcohols, glycols, ketones, esters and amides. The reduction sensitizer may be previously added to the reactor but is preferably added in an appropriate timing during the grain growth. It is also possible to add the reduction sensitizers to an aqueous solution of a water-soluble silver salt or a water-soluble alkali halide and precipitate silver halide grains using this aqueous solution. In another preferred method, as the grains grow, a solution of the reduction sensitizer is added in several parts or is continuously added over a long period of time.

In the process of producing the emulsion, an oxidizing agent for silver is preferably used. The oxidizing agent for silver means a compound having a function of acting on metal silver and converting it into silver ion. In particular, a compound which converts very fine silver grains generated as a by-product in the process of performing the formation and the chemical sensitization of silver halide grains, into silver ion is effective. The silver ion produced here may form a sparingly water-soluble silver salt such as silver halide, silver sulfide or silver selenide or may form an easily water-soluble silver salt such as silver nitrate. The oxidizing agent for silver may be either an inorganic material or an organic material. Examples of the inorganic oxidizing agent include ozone, hydrogen peroxide and its adducts (e.g., $NaBO_2.H_2O_2.3H_2O$, $2NaCO_3.3H_2O_2$, $Na_4P_2O_7.2H_2O_2$, $2Na_2SO_4.H_2O_2.2H_2O$), peroxy acid salts (e.g., $K_2S_2O_8$, $K_2C_2O_6$, $K_2P_2O_8$) peroxy complex compounds (e.g., $K_2[Ti(O_2)C_2O_4].3H_2O$, $4K_2SO_4.Ti(O_2)OH.SO_42H_2O$, $Na_3[VO(O_2)(C_2H_4)_2].6H_2O$), permanganates (e.g., $KMnO_4$), oxyacid salts such as chromate (e.g., $K_2Cr_2O_7$), halogen elements such as iodine and bromine, perhalogenates (e.g., potassium periodate), high-valence metal salts (e.g., potassium hexacyanoferrate) and thiosulfonates.

Examples of the organic oxidizing agent include quinones such as p-quinone, organic peroxides such as peracetic acid and perbenzoic acid, and compounds capable of releasing an active halogen (for example, N-bromosuccinimide, chloramine T and chloramine B).

The oxidizing agent is preferably an inorganic oxidizing agent such as ozone, hydrogen peroxide or its adduct, halogen element or thiosulfonate, or an organic oxidizing agent such as quinones. In a preferred embodiment, the above-described reduction sensitization and the oxidizing agent for silver are used in combination. In this case, a method of using the oxidizing agent and then applying the reduction sensitization, a method reversed thereto, or a method of allowing the reduction sensitizer and the oxidizing agent to be present together at the same time may be used. These methods each can be used either during the grain formation or during the chemical sensitization.

The photographic emulsion for use in the present invention may contain various compounds in order to prevent fogging during the production, storage or photographic processing of a light-sensitive material, or to stabilize the photographic performance. Examples of the compounds which can be added include a large number of compounds known as an antifoggant or a stabilizer, more specifically, thiazoles (e.g., benzothiazolium salt), nitroimidazoles, nitrobenzimidazoles, chlorobenzimidazoles, bromobenzimidazoles, mercaptothiazoles, mercaptobenzothiazoles, mecaptobenzimidazoles, mercaptothiadiazoles, aminotriazoles, benzotriazoles, nitrobenzotriazoles, mercaptotetrazoles (particularly 1-phenyl-5-mercaptotetrazole), mercaptopyrimidines, mercaptotriazines, thioketo compounds (e.g., oxazolinethione), and azaindenes such as triazaindenes, tetrazaindenes (particularly 4-hydroxy-substituted (1,3,3a,7) tetrazaindenes) and pentazaindenes. For example, the compounds described in U.S. Pat. Nos. 3,954,474 and 3,982,947 and JP-B-52-28660 can be used. One of preferred compounds is the compound described in JP-A-63-212932. The antifoggant and the stabilizer can be added according to the purpose in various timings such as before grain formation, during grain formation, after grain formation, during water washing, during dispersion after water washing, before chemical sensitization, during chemical sensitization, after chemical sensitization, and before coating. These compounds can be used not only to exert their original effect of preventing fogging and stabilizing the photographic performance but also for other various purposes, for example, to control the crystal habit of grain, to reduce the grain size, to decrease the solubility of grain, to control the chemical sensitization or to control the arrangement of dyes.

The silver halide material prepared according to the present invention can be used for either a color photographic light-sensitive material or a black-and-white photographic light-sensitive material. Examples of the color photographic light-sensitive material include color printing paper, film for color photographing, color reversal film and color diffusion transfer film, and examples of the black-and-white photographic light-sensitive material include film for general photographing, X-ray film, film for medical diagnosis, film for printing light-sensitive material and diffusion transfer film.

In the field of film for medical diagnosis and film for printing light-sensitive material, the exposure can be efficiently performed using a laser image setter or a laser imager.

The technique in this field is described in JP-A-7-287337, JP-A-4-335342, JP-A-5-313289, JP-A-8-122954 and JP-A-8-292512.

Also, the present invention may be used for a photothermographic (light-sensitive) material. For example, a material having a light-sensitive layer comprising a binder matrix having dispersed therein a catalytic amount of photocatalyst (e.g., silver halide), a reducing agent, a reducible silver salt (e.g., organic silver salt) and if desired, a color toning agent for controlling the color of silver, is known. Examples thereof include those described in U.S. Pat. Nos. 3,152,904, 3,457,075, 2,910,377 and 4,500,626, JP-B-43-4924, JP-A-11-24200, JP-A-11-24201, JP-A-11-30832, JP-A-11-84574, JP-A-11-65021, JP-A-11-109547, JP-A-11-125880, JP-A-11-129629, JP-A-11-133536 to JP-A-11-133539, JP-A-11-133542, JP-A-11-133543, JP-A-11-223898, JP-A-11-352627, JP-A-6-130607, JP-A-6-332134, JP-A-6-332136, JP-A-6-347970, JP-A-7-261354 and JP-A-2001-281785.

The compound of the present invention may also be preferably used for a diffusion transfer light-sensitive material. In this regard, the heat-developable diffusion transfer system is described in JP-A-2000-98562 (Japanese Patent Application No. 10-265273) (using a preformed dye) and JP-A-2001-281785 (using a coupling-formation dye), and the instant photographic system is described in JP-A-2000-284442 (Japanese Patent Application No. 11-89801).

With respect to the preparation method and the like of the photographic emulsion for use in the present invention, those described in JP-A-10-239789, column 63, line 36 to column 65, line 2, may be applied.

Furthermore, with respect to the additives such as color coupler, additives to the photographic light-sensitive material, the kind of light-sensitive material to which the present invention can be applied, and the processing of the light-sensitive material, those described in JP-A-10-239789, column 65, line 3 to column 73, line 13 may be applied.

In the silver halide photographic light-sensitive material of the present invention, various additives described above are used and other than these, various additives may also be used according to the purpose.

These additives are described in more detail in *Research Disclosure*, Item 17643 (December, 1978), ibid., Item 18716 (November, 1979), and ibid., Item 308119 (December, 1989). The pertinent portions are summarized in the table below.

| Kinds of Additives | RD17643 | RD18716 | RD308119 |
|---|---|---|---|
| 1. Chemical sensitizer | page 23 | page 648, right column | page 996 |
| 2. Sensitivity increasing agent | | page 648, right column | |
| 3. Spectral sensitizer, supersensitizer | pages 23 to 24 | page 648, right column to page 649, right column | page 996, right to page 998, right |
| 4. Brightening agent | page 24 | | page 998, right |
| 5. Antifoggant, stabilizer | pages 24 to 25 | page 649, right column | page 998, right to page 1000, right |
| 6. Light absorbent, filter dye, UV absorbent | pages 25 to 26 | page 649, right column to page 650, left column | page 1003, left to page 1003, right |
| 7. Stain inhibitor | page 25, right column | page 650, left to right columns | page 1002, right |
| 8. Dye Image Stabilizer | page 25 | | page 1002, right |
| 9. Hardening agent | page 26 | page 651, left column | page 1004, right to page 1005, left |
| 10. Binder | page 26 | Page 561, left column | page 1003, right to page 1004, right |
| 11. Plasticizer, lubricant | page 27 | page 650, right column | page 1006, left to page 1006, right |
| 12. Coating aid, surfactant | pages 26 to 27 | page 650, right column | page 1005, left to page 1006, left |
| 13. Antistatic agent | page 27 | page 650, right column | page 1006, right to page 1007, left |
| 14. Matting agent | | | page 1008, left to page 1009, left |

The technique such as layer arrangement, the silver halide emulsion, the dye forming coupler, the functional coupler such as DIR coupler, various additives and the development processing, which can be used in the emulsion of the present invention and in the photographic light-sensitive material using the emulsion, are described in EP 0565096A1

(published on Oct. 13, 1993) and patents cited therein. Respective items and corresponding portions therefor are listed below.

| | | |
|---|---|---|
| 1. | Layer construction: | page 61, lines 23 to 35, page 61, line 41 to page 62 line 14 |
| 2. | Interlayer: | page 61, lines 36 to 40 |
| 3. | Interlayer effect-imparting layer: | page 62, lines 15 to 18 |
| 4. | Silver halide halogen composition: | page 62, lines 21 to 25 |
| 5. | Crystal habit of silver halide grain: | page 62, lines 26 to 30 |
| 6. | Silver halide grain size: | page 62, lines 31 to 34 |
| 7. | Emulsion production method: | page 62, lines 35 to 40 |
| 8. | Silver halide grain size distribution: | page 62, lines 41 to 42 |
| 9. | Tabular grain: | page 62, lines 43 to 46 |
| 10. | Internal structure of grain: | page 62, lines 47 to 53 |
| 11. | Latent image forming-type emulsion: | page 62, line 54 to page 63, line 5 |
| 12. | Physical ripening and chemical ripening of emulsion: | page 63, lines 6 to 9 |
| 13. | Use of emulsions in mixture: | page 63, lines 10 to 13 |
| 14. | Fogged emulsion: | page 63, lines 14 to 31 |
| 15. | Light-insensitive emulsion: | page 63, lines 32 to 43 |
| 16. | Coated silver amount: | page 63, lines 49 to 50 |
| 17. | Formaldehyde scavenger: | page 64, lines 54 to 57 |
| 18. | Mercapto-based antifoggant: | page 65, lines 1 to 2 |
| 19. | Agent for releasing fogging agent, etc.: | page 65, lines 3 to 7 |
| 20. | Dyes: | page 65, lines 7 to 10 |
| 21. | Color coupler in general: | page 65, lines 11 to 13 |
| 22. | Yellow, magenta and cyan couplers: | page 65, lines 14 to 25 |
| 23. | Polymer coupler: | page 65, lines 26 to 28 |
| 24. | Diffusible dye-forming coupler: | page 65, lines 29 to 31 |
| 25. | Colored coupler: | page 65, lines 32 to 38 |
| 26. | Functional coupler in general: | page 65, lines 39 to 44 |
| 27. | Bleaching accelerator-releasing coupler: | page 65, lines 45 to 48 |
| 28. | Development accelerator-releasing coupler: | page 65, lines 49 to 53 |
| 29. | Other DIR couplers: | page 65, line 54 to page 66, line 4, |
| 30. | Coupler dispersion method: | page 66, lines 5 to 28 |
| 31. | Antiseptic and antifungal: | page 66, lines 29 to 33 |
| 32. | Kind of light-sensitive material: | page 66, lines 34 to 36 |
| 33. | Thickness and swelling rate of light-sensitive layer: | page 66, line 40 to page 67, line 1 |
| 34. | Back layer: | page 67, lines 3 to 8 |
| 35. | Development processing in general: | page 67, lines 9 to 11 |
| 36. | Developer and developing agent: | page 67, lines 12 to 30 |
| 37. | Additive for developer: | page 67, lines 31 to 44 |
| 38. | Reversal processing: | page 67, lines 45 to 56 |
| 39. | Opening ratio of processing solution: | page 67, line 57 to page 68, line 12 |
| 40. | Development time: | page 68, lines 13 to 15 |
| 41. | Bleach-fixing, bleaching and fixing: | page 68, line 16 to page 69, line 31 |
| 42. | Automatic developing machine: | page 69, lines 32 to 40 |
| 43. | Water washing, rinsing and stabilization: | page 69, line 41 to page 70, line 18 |
| 44. | Replenishment and re-use of processing solution: | page 70, lines 19 to 23 |
| 45. | Light-sensitive material-intercalating developing agent: | page 70, lines 24 to 33 |

-continued

| | | |
|---|---|---|
| 46. | Development processing temperature: | page 70, lines 34 to 38 |
| 47. | Use for film with lens: | page 70, lines 39 to 41 |

The method for exposing the silver halide photographic light-sensitive material of the present invention is described below.

Exposure for obtaining a photographic image may be performed using a normal method. More specifically, any of various known light sources can be used, such as natural light (sunlight), tungsten lamp, mercury vapor lamp, xenon arc lamp, carbon arc lamp, xenon flash lamp, laser, LED and CRT. Also, the light-sensitive photographic material may be exposed by light emitted from a phosphor excited by an electron beam, an X ray, a $\gamma$ (gamma) ray or an $\alpha$ (alpha) ray.

In the present invention, a laser light source is sometimes preferably used. Examples of the laser ray include those using a helium-neon gas, an argon gas, a krypton gas or a carbon dioxide gas as the laser oscillation medium, those using a solid such as ruby or cadmium as the oscillation medium, a liquid laser and a semiconductor laser. Unlike light usually used for illumination and the like, these laser rays are coherent light having sharp directivity with uniform phase and single frequency and therefore, the silver halide photographic light-sensitive material exposed using such a laser ray as a light source must have spectral properties coincided with the oscillation wavelength of the laser used.

Among the above-described lasers, use of a semiconductor laser is preferred.

The methine dye of the present invention can be used not only as a sensitizing dye but also as a filter dye, an irradiation inhibiting dye or an antihalation dye for the purpose of improving the sharpness and color resolution.

This compound can be incorporated into a coating solution for a silver halide photographic light-sensitive material layer, a filter layer and/or an antihalation layer by a method commonly used. The amount of the dye used may be sufficient if it is large enough to color the photographic material, and one skilled in the art can easily select this appropriate amount according to the use end. In general, the compound is preferably used to give an optical density of 0.05 to 3.0. The timing of adding the compound may be any step before the coating.

Also, a polymer having an electric charge opposite the dye ion may be used as a mordant and allowed to be present together in a layer so as to interact with the dye molecule and thereby localize the dye in a specific layer.

Examples of the polymer mordant include those described in U.S. Pat. Nos. 2,548,564, 4,124,386, 3,625,694, 3,958, 995, 4,168,976 and 3,445,231.

The compound of the present invention can be added to a desired layer in addition to the light-sensitive emulsion layer, such as interlayer, protective layer and back layer.

The methine dye of the present invention can be used as a photosensitizer (photo-charge separating agent) in various non-silver salt system photo-image forming methods or may be used for photocatalyst, photo-hydrogen generating agent and the like.

In the present invention, the light absorption intensity is an integrated intensity of light absorption by a sensitizing dye per unit grain surface area and is defined as a value obtained, assuming that the quantity of light entered into the unit surface area of a grain is $I_0$ and the quantity of light absorbed by a sensitizing dye on the surface is I, by integrating the optical density $\mathrm{Log}(I_0/(I_0-I))$ to the wave number ($cm^{-1}$). The integration range is from 5,000 $cm^{-1}$ to 35,000 $cm^{-1}$.

The silver halide photographic emulsion according to the present invention preferably contains silver halide grains having a light absorption intensity of 100 or more in the case of a grain having a spectral absorption maximum wavelength of 500 nm or more, or silver halide grains having a light absorption intensity of 60 or more in the case of a grain having a spectral absorption maximum wavelength of less than 500 nm, in a proportion of a half (½) or more of the entire projected area of all silver halide grains. In the case of a grain having a spectral absorption maximum wavelength of 500 nm or more, the light absorption intensity is preferably 150 or more, more preferably 170 or more, still more preferably 200 or more. In the case of a grain having a spectral absorption maximum wavelength of less than 500 nm, the light absorption intensity is preferably 90 or more, more preferably 100 or more, still more preferably 120 or more. The upper limit is not particularly specified but it is preferably 2,000 or less, more preferably 1,000 or less, still more preferably 500 or less.

As for grains having a spectral absorption maximum wavelength of less than 500 nm, the spectral absorption maximum wavelength is preferably 350 nm or more.

One example of the method for measuring the light absorption intensity is a method of using a microspectrophotometer. The microspectrophotometer is a device capable of measuring an absorption spectrum of a microscopic area and can measure the transmission spectrum of one grain. The measurement of absorption spectrum of one grain by the microspectrometry is described in the report by Yamashita et al. (*Nippon Shashin Gakkai,* 1996 *Nendo Nenji Taikai Ko'en Yoshi Shu* (*Lecture Summary at Annual Meeting of Japan Photographic Association in* 1996), page 15). From this absorption spectrum, an absorption intensity per one grain can be obtained, however, the transmitted light through the grain is absorbed on two surfaces of upper surface and lower surface and therefore, the absorption intensity per unit area on the grain surface can be obtained as a half (½) of the absorption intensity per one grain determined by the above-described method. At this time, the segment used for the integration of absorption spectra is from 5,000 to 35,000 $cm^{-1}$ in the definition, however, in experiment, the segment for integration may contain the region of 500 $cm^{-1}$ shorter or longer than the segment having absorption by the sensitizing dye.

The light absorption intensity is a value indiscriminately determined by the oscillator strength of sensitizing dye and the number of adsorbed molecules per unit area and therefore, when the oscillator strength of sensitizing dye, the amount of dye adsorbed and the surface area of grain are determined, the light absorption intensity can be calculated therefrom.

The oscillator strength of sensitizing dye can be experimentally determined as a value proportional to the absorption integrated intensity (optical density×$cm^{-1}$) of the sensitizing dye solution. Therefore, assuming that the absorption integrated intensity of a dye per 1 M is A (optical density×$cm^{-1}$), the amount of sensitizing dye adsorbed is B (mol/mol-Ag) and the surface area of grain is C ($m^2$/mol-Ag), the light absorption intensity can be determined according to the following formula within an error range of about 10%:

$$0.156 \times A \times B/C$$

The light absorption intensity calculated according to this formula is substantially the same as the light absorption intensity measured based on the above-described definition (a value obtained by the integration of $Log(I_0/(I_0-I))$ to the wave number ($cm^{-1}$))

For increasing the light absorption intensity, a method of adsorbing a dye chromophore in one or more layers onto the grain surface, a method of increasing the molecular extinction coefficient of dye, or a method of reducing the dye occupation area may be used. Any of these methods may be used but preferred is the method of adsorbing a dye chromophore in one or more layers onto the grain surface.

Here, the state where a dye chromophore is adsorbed in one or more layers onto the grain surface means that the dye bounded to the vicinity of a silver halide grain is present in one or more layers. Dyes present in the dispersion medium is not included. Incidentally, the term "in one or more layers" as used herein includes the case where as in the present invention, a dye chromophore is connected to a compound adsorbed to the grain surface, such as dye, through a covalent bond. In this case, spectral sensitization must be generated by a dye not directly adsorbed to the grain surface and for this purpose, an excitation energy must be transmitted from the dye not directly adsorbed to silver halide to the dye directly adsorbing to a grain. In this meaning, the excitation energy transmission required to pass through 10 stages or more is not preferred because the transmission efficiency of final excitation energy decreases. One example of such a case is a polymer dye described in JP-A-2-113239 where a majority of dye chromophores are present in a dispersion medium and the excitation energy must be transmitted through 10 stages or more.

The dye chromophore adsorbed to a silver halide grain is preferably in 1.5 or more layers, more preferably in 1.7 or more layers, still more preferably in 2 or more layers.

In the present invention, the state where a chromophore is adsorbed in one or more layers onto the surface of a silver halide grain means that when saturated adsorption amount achieved by, out of the sensitizing dyes added to the emulsion, a dye having a smallest dye occupation area on the surface of a silver halide grain is defined as a single layer saturated coverage, the adsorption amount of a dye chromophore per unit area is larger than this single layer saturated coverage. The adsorption layer number means an adsorption amount based on the single layer saturated coverage. In the case of a dye where dye chromophores are connected through a covalent bond, the adsorption layer number may be based on the dye occupation area of individual dyes in the state of not being connected. The dye occupation area may be obtained from an adsorption isothermal line showing the relationship between the concentration of free dye and the amount of dye adsorbed, and the surface area of a grain. The adsorption isothermal line may be obtained by referring, for example, to A. Herz et al., *Adsorption from Aqueous Solution, Advances in chemistry Series*), No. 17, page 173 (1968).

For determining the amount of a sensitizing dye adsorbed to an emulsion layer, two methods may be used, namely, one is a method of centrifuging an emulsion having adsorbed thereto a dye to separate emulsion grains from the supernatant aqueous gelatin solution, measuring the spectral absorption of the supernatant to determine the concentration of non-adsorbed dye, subtracting the obtained concentration from the amount of dye added and thereby determining the amount of dye adsorbed, and another is a method of drying precipitated emulsion grains, dissolving a predetermined weight of the precipitate in a 1:1 mixed solution of aqueous sodium thiosulfate solution and methanol, measuring the spectral absorption and thereby determining the amount of dye adsorbed. In the case of using a plurality of dyes, the adsorption amount may also be obtained for individual dyes using means such as high-performance liquid chromatography.

The dye occupation area can be experimentally determined, however, since the molecular occupation areas of sensitizing dyes usually used are mostly present in the vicinity of 80 Å$^2$, the adsorption layer number may also be roughly estimated by simply considering that all dyes have a dye occupation area of 80 Å$^2$.

In the silver halide photographic emulsion containing the compound of the present invention as a sensitizing dye, the distance between the shortest wavelength showing 50% of a maximum value Amax of the spectral absorption factor by a sensitizing dye and showing 50% of a maximum value Smax of the spectral sensitivity and the longest wavelength showing 50% of Amax and 50% of Smax is preferably 120 nm or less, more preferably 100 nm or less.

The distance between the shortest wavelength showing 80% of Amax and 80% of Smax and the longest wavelength showing 80% of Amax and 80% of Smax is preferably 20 nm or more, more preferably 100 nm or less, still more preferably 80 nm or less, and particularly preferably 50 nm or less.

The distance between the shortest wavelength showing 20% of Amax and 20% of Smax and the longest wavelength showing 20% of Amax and 20% of Smax is preferably 180 nm or less, more preferably 150 nm or less, still more preferably 120 nm or less, and most preferably 100 nm or less.

The longest wavelength showing 50% of Amax and 50% of Smax, of the spectral adsorption factor is preferably from 460 to 510 nm, from 560 nm to 610 nm, or from 640 to 730 nm.

In the present invention, when a dye chromophore is adsorbed in multiple layers onto a silver halide grain, the dye chromophore directly adsorbing to the silver halide grain, namely, dye chromophore in the first layer, and the dye chromophores in the second and upper layers may have any reduction potential and any oxidation potential, however, from the standpoint of accelerating the electron transfer from the dye in the second or upper layer to the dye in the first layer and preventing the reverse electron transfer, the reduction potential of the dye chromophore in the first layer is preferably more positive than the value obtained by subtracting 0.2 v from the reduction potential of the dye chromophore in the second or upper layer, and the reduction potential of the dye chromophore in the first layer is preferably more positive than the reduction potential of the dye chromophore in the second or upper layer.

The reduction potential and the oxidation potential may be measured by various methods, however, these are preferably measured by phase discriminating second harmonic a.c. polarography, by which exact values can be obtained. The method for determining the potential by phase discriminating second harmonic a.c. polarography is described in *Journal of Imaging Science*, Vol. 30, page 27 (1986).

The dye chromophore in the second or upper layer is preferably a light-emitting dye. The light-emitting dye preferably has a basic structure of dyes used for dye laser. These are described, for example, in Mitsuo Maeda, *Laser Kenkyu* (*Study of Laser*), Vol. 8, page 694, page 803 and page 958 (1980), ibid., Vol. 9, page 85 (1981), and F. Shaefer, *Dye Lasers*, Springer (1973).

In view of efficiency in the energy transfer from the dye in the second or upper layer to the dye in the first layer, the absorption maximum wavelength of the dye chromophore in the first layer in a silver halide photographic light-sensitive material is preferably longer than the absorption maximum wavelength of the dye chromophore in the second or upper layer, and also the light emission of the dye chromophore in the second or upper layer preferably overlaps the absorption of the dye chromophore in the first layer. In addition, the dye chromophore in the first layer preferably forms a J-aggregate. In order to have absorption and spectral sensitivity in a desired wavelength range, the dye chromophores in the second and upper layers also preferably form a J-aggregate.

In the energy transfer of the excitation energy of the second layer dye to the first layer dye, the energy transfer efficiency is preferably 30% or more, more preferably 60% or more, still more preferably 90% or more. The term "excitation energy of the second layer dye" as used herein means an energy of a dye in the excited state resulting from the second layer dye absorbing light energy. In the case where an excitation energy of a certain molecule transfers to another molecule, the excitation energy is considered to transfer through an excitation electron transfer mechanism, a Forster type energy transfer mechanism (Forster Model), a Dextor energy transfer mechanism (Dextor Model) or the like. Accordingly, it is preferred that the multilayer adsorption system of the present invention also satisfies the conditions for causing an efficient excitation energy transfer available by these mechanisms, more preferably the conditions for causing a Forster type energy transfer.

The efficiency in the energy transfer from the second layer dye to the first layer dye can be obtained as (spectral sensitization efficiency at the excitation of second layer dye)/(spectral sensitization efficiency at the excitation of first layer dye).

The meanings of the terms used in the present invention are described below.

Dye Occupation Area:

An occupation area per one molecule of dye. This can be experimentally determined from the adsorption isothermal line. In the case of a dye where dye chromophores are connected through a covalent bond, the dye occupation area is based on the dye occupation area of individual dyes in the state of not being connected. Simply, 80 Å$^2$.

Single Layer Saturation Coverage:

An adsorption amount of dye per unit grain surface area at the time of single layer saturation covering. A reciprocal of the minimum dye occupation area out of dyes added.

Multilayer Adsorption:

A state where the adsorption amount of dye chromophore per unit grain surface area is larger than the single layer saturation coverage. In the present invention, since the multilayer adsorption means the state where the adsorption amount of dye chromophore per unit grain surface area is larger than the single layer saturation coverage, when a dye containing two dye chromophores connected through a covalent bond is adsorbed as a one-layer portion, this means that the dye is adsorbed in two layers.

Adsorption Layer Number:

An adsorption amount of dye chromophore per unit grain surface area based on the single layer saturation coverage. In the case of a compound where two dye chromophores are connected through a covalent bond, the adsorption layer number is defined as the above-described adsorption amount×2. For example, when a dye containing two dye chromophores connected through a covalent bond is supposed to have the same dye occupation area and the same adsorption amount as those of certain non-connected model dyes, the adsorption layer number is 2.

EXAMPLE

The present invention is described in greater detail below by referring to Examples, however, the present invention should not be construed as being limited thereto.

Example 1

(1) Synthesis Example of Compound D-15 of the Present Invention

Synthesis of D-15:

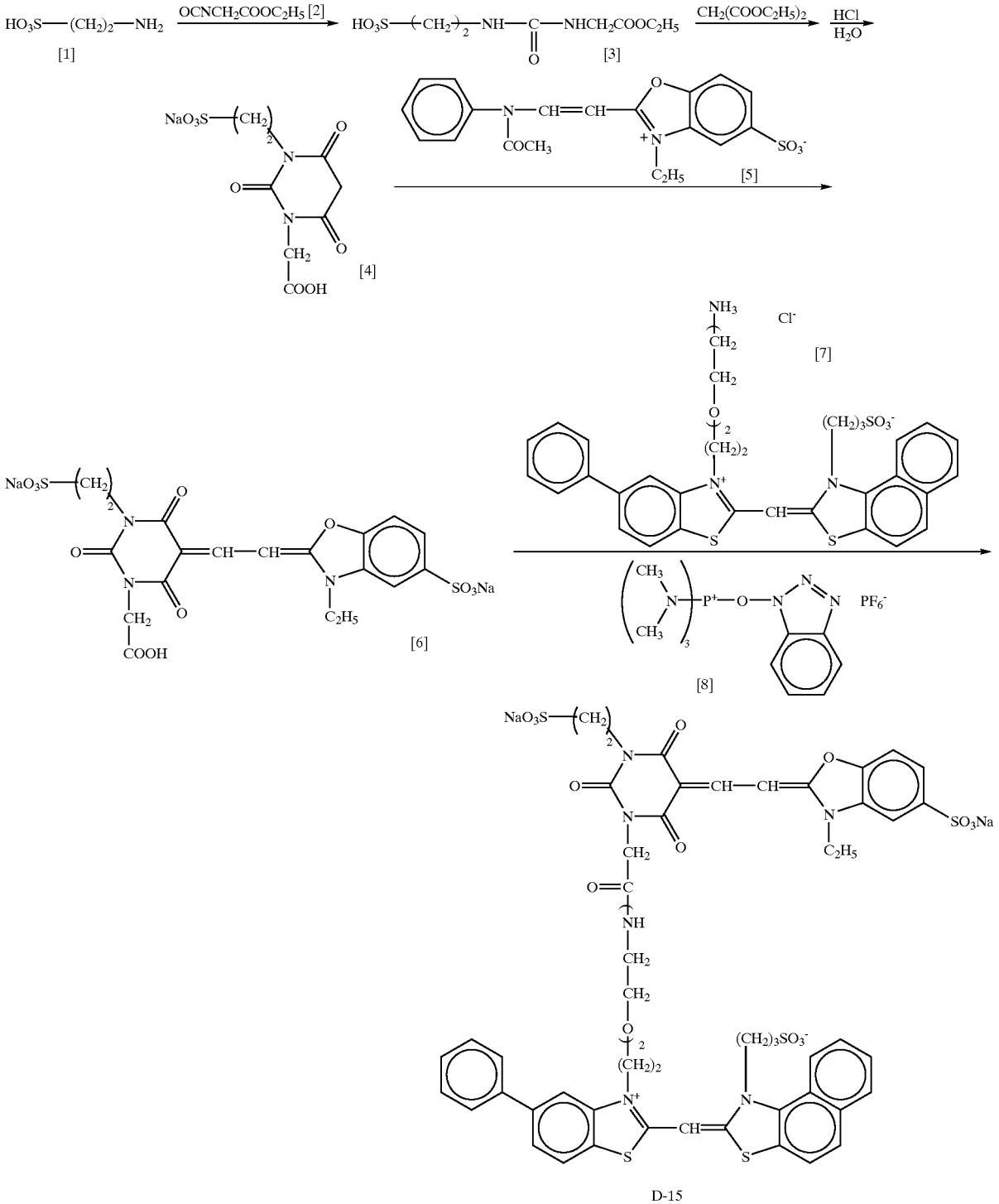

In 100 ml of ethanol and 100 ml of water, 26.3 g (0.21 mol) of taurine [1] and 8.4 g (0.21 mol) of sodium hydroxide were dissolved. While cooling to 0° C., 30.0 g (0.23 mol) of isocyanate [2] was added dropwise and stirred for 30 minutes. After further stirring for 30 minutes at room temperature, the solution was heated under reflux for 1 hour. After the concentration, ethyl acetate was added and the crystals were separated by filtration and washed with ethyl acetate to obtain 56.7 g (yield: 98%) of urea [3] as white crystals.

56.7 g (0.205 mol) of urea [3], 91.2 g (0.57 mol) of diethyl malonate and 31 g (0.57 mol) of sodium mothoxide were added to 300 ml of ethanol and the resulting solution was heated under reflux for 5 hours. Insoluble matters while in a hot state were removed by filtration and the filtrate was washed with methanol and then concentrated. Thereafter, 40 ml of hydrochloric acid and 120 ml of acetic acid were added and the resulting solution was heated under reflux for 4 hours. After the concentration, acetone was added and crystals were separated by filtration to obtain 49.5 g (yield: 76%) of barbituric acid [4] crystals.

3.8 g (12 mmol) of barbituric acid [4], 2.3 g (6 mmol) of anil form, 4.9 g (48 mmol) of triethylamine and 0.6 g (6 mmol) of acetic anhydride were added to 100 ml of ethanol and the resulting solution was heated under reflux for one hour. After the concentration, the concentrate was dissolved in methanol and thereto, 0.1 g (12 mmol) of sodium acetate was added. The precipitated crystals were separated by filtration and washed with methanol to obtain 0.92 g (yield: 26%) of merocyanine dye [6] as yellow crystals.

In 30 ml of dimethylsulfoxide, cyanine dye [7] prepared by referring to the method described in EP-A-887700, 0.55 g (0.93 mmol) of merocyanine dye [6] and 0.13 g (0.93 mmol) of 1-hydroxybenzotriazole were dissolved. The resulting solution was stirred at 60° C. for 10 minutes and thereto, 0.49 g (1.1 mmol) of phosphonium salt [8] and 0.48 g (3.7 mmol) of diisopropylethylamine were added. The resulting solution was stirred at 60° C. for 3 hours and after cooling, 300 ml of acetone was added. The precipitated crystals were separated by filtration and the crystals were dissolved in methanol. Thereto, 0.16 g (2 mmol) of sodium acetate was added and the generated crystals were separated by filtration, washed with methanol and then dried in vacuum to obtain 0.34 g (yield: 45%) of the objective D-15 as yellow crystals.

The structure thereof was confirmed by NMR spectrum, MS spectrum and elemental analysis.

(2) Synthesis Example of Compound D-9 of the Present Invention

Synthesis of D-9:

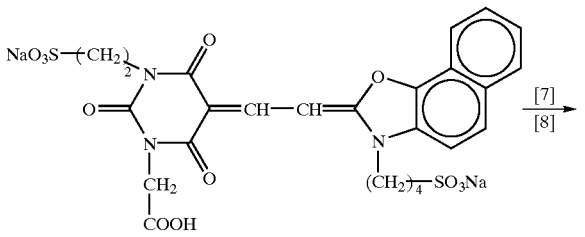

[9]

-continued

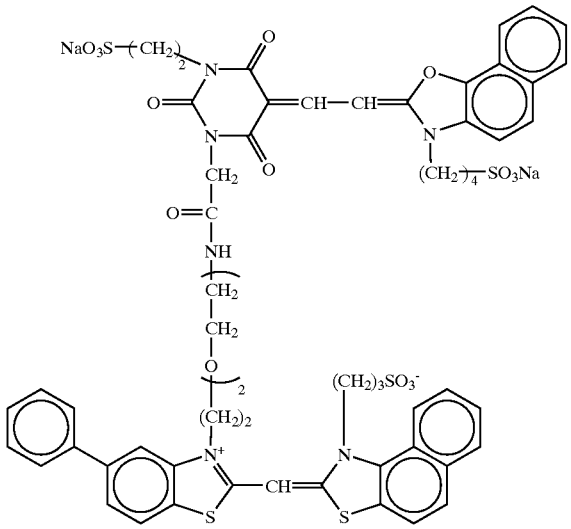

D-9

In 30 ml of dimethylsulfoxide, 0.8 g (1.2 mmol) of merocyanine dye [9] prepared in the same manner as D-15, 0.52 g (0.75 mmol) of cyanine dye [7] and 0.16 g (1.2 mmol) of 1-hydroxybenzotriazole were dissolved. The resulting solution was stirred at 60° C. for 10 minutes and thereto, 0.60 g (1.44 mmol) of phosphonium salt [8] and 0.62 g (4.8 mmol) of diisopropylethylamine were added. The resulting solution was stirred at 60° C. for 3 hours and after cooling, 300 ml of acetone was added. The precipitated crystals were separated by filtration and dissolved in methanol. Thereto, 0.16 g (2 mmol) of sodium acetate was added and the precipitated crystals were separated by filtration, washed with methanol and dried in vacuum to obtain 0.48 g (yield: 48%) of the objective D-9 as yellow crystals.

The structure thereof was confirmed by NMR spectrum, MS spectrum and elemental analysis.

Other compounds of the present invention can be synthesized in the same manner as above.

Example 2

(Preparation of Seed Emulsion a)

1,164 ml of an aqueous solution containing 0.017 g of KBr and 0.4 g of an acid-treated gelatin having an average molecular weight of 20,000 was stirred while keeping it at 35° C. Thereto, an aqueous $AgNO_3$ (1.6 g) solution, an aqueous KBr solution and an aqueous solution of acid-treated gelatin (2.1 g) having an average molecular weight of 20,000 were added by a triple jet method over 48 seconds. At this time, the silver potential was kept at 13 mV to the saturated calomel electrode. To the solution obtained, an aqueous KBr solution was added and after adjusting the silver potential to −66 mV, the temperature was elevated to 60° C. Thereafter, 21 g of succinated gelatin having an average molecular weight of 100,000 was added and then an aqueous NaCl (5.1 g) solution was added. Subsequently, an aqueous $AgNO_3$ (206.3 g) solution and an aqueous KBr solution were added by a double jet method over 61 minutes while accelerating each flow rate. At this time, the silver potential was kept at −44 mV to the saturated calomel electrode. After desalting, succinated gelatin having an average molecular weight of 100,000 was added and the pH and the pAg were adjusted at 40° C. to 5.8 and 8.8, respectively, to prepare a seed emulsion. This seed emulsion was an emulsion of tabular grains containing 1 mol of Ag and 80 g of gelatin, per 1 kg of the emulsion and having an average equivalent-circle diameter of 1.46 μm, a coefficient of variation in the equivalent-circle diameter of 28%, an average thickness of 0.046 μm and an average aspect ratio of 32.

(Formation of Core)

1,200 ml of an aqueous solution containing 134 g of Seed Emulsion a prepared above, 1.9 g of KBr and 22 g of succinated gelatin having an average molecular weight of 100,000 was stirred while keeping it at 75° C. Thereto, an aqueous $AgNO_3$ (43.9 g) solution, an aqueous KBr solution and an aqueous solution of gelatin having a molecular weight of 20,000, which were mixed in a separate chamber having a magnetic coupling induction-type stirring machine described in JP-A-10-43570 immediately before the addition, were added over 25 minutes. At this time, the silver potential was kept at −40 mV to the saturated calomel electrode.

(Formation of First Shell)

After the formation of core grains, an aqueous $AgNO_3$ (43.9 g) solution, an aqueous KBr solution and an aqueous solution of gelatin having a molecular weight of 20,000, which were mixed in the same separate chamber as above immediately before the addition, were added over 20 minutes. At this time, the silver potential was kept at −40 mV to the saturated calomel electrode.

(Formation of Second Shell)

After the formation of the first shell, an aqueous $AgNO_3$ (42.6 g) solution, an aqueous KBr solution and an aqueous solution of gelatin having a molecular weight of 20,000, which were mixed in the same separate chamber as above immediately before the addition, were added over 17 minutes. At this time, the silver potential was kept at −20 mV to the saturated calomel electrode. Thereafter, the temperature was lowered to 55° C.

(Formation of Third Shell)

After the formation of the second shell, the silver potential was adjusted to −55 mV and then, an aqueous $AgNO_3$ (7.1 g) solution, an aqueous KI (6.9 g) solution and an aqueous solution of gelatin having a molecular weight of 20,000, which were mixed in the same separate chamber as above immediately before the addition, were added over 5 minutes.

(Formation of Fourth Shell)

After the formation of the third shell, an aqueous $AgNO_3$ (66.4 g) solution and an aqueous KBr solution were added each at a constant flow rate over 30 minutes by a double jet method. On the way of addition, potassium iridium hexachloride and yellow prussiate of potash were added. At this time, the silver potential was kept at 30 mV to the saturated calomel electrode. The resulting solution was subjected to normal water washing, gelatin was added thereto, and the pH and the pAg were adjusted at 40° C. to 5.8 and 8.8, respectively. This emulsion was designated as Emulsion b. Emulsion b was an emulsion of tabular grains having an average equivalent-circle diameter of 3.3 μm, a coefficient of variation in the equivalent-circle diameter of 21%, an average thickness of 0.090 μm and an average aspect ratio of 37. In the emulsion, 70% or more of the entire projected area was occupied by tabular grains having an equivalent-circle diameter of 3.3 μm or more and a thickness of 0.090 μm or less. Assuming that the dye occupation area was 80 $Å^2$, the single layer saturation coverage was $1.45\times10^{-3}$ mol/mol-Ag.

The temperature of Emulsion b was elevated to 56° C. and after adding $1.2\times10^{-3}$ mol/mol-Ag of Comparative Dye S-1 shown below, chemical sensitization was optimally performed by adding C-5, potassium thiocyanate, chloroauric acid, sodium thiosulfate and N,N-dimethylselenourea. Furthermore, $2.5\times10^{-4}$ mol/mol-Ag of S-1 was added and the resulting mixture was stirred for 60 minutes to prepare an emulsion for Comparative Example 1.

(2) Measurements of Light Absorption Intensity and Adsorption Amount

The light absorption intensity per unit area was measured as follows. The emulsion obtained was coated to a small thickness on a slide glass and the transmission spectrum and reflection spectrum of individual grains were determined using a microspectrophotometer MSP65 manufactured by Karl Zweiss K.K. by the following method to determine the absorption spectrum. The area where grains were not present was used as the reference for the transmission spectrum, and the reference for the reflection spectrum was obtained by measuring silicon carbide of which reflectance is known. The measured area is a circular aperture part having a diameter of 1 μm. After adjusting the position not to allow the aperture part to overlap the contour of a grain, the transmission spectrum and the reflection spectrum were measured in the wave number region from 14,000 $cm^{-1}$ (714 nm) to 28,000 $cm^{-1}$ (357 nm). The absorption spectrum was determined from the absorption factor A which is 131 T (transmittance)−R (reflectance). Using the absorption factor A' obtained by subtracting the absorption of silver halide, -Log(1−A') was integrated to the wave number ($cm^{-1}$) and the value obtained was halved and used as a light absorption intensity per unit area. The integration range was from 14,000 to 28,000 $cm^{-1}$. At this time, the light source used was a tungsten lamp and the light source voltage was 8 V. In order to minimize the damage of the dye by the light irradiation, a monochromator in the primary side was used and the wavelength distance and the slit width were set to 2 nm and 2.5 nm, respectively. The absorption spectrum and the light absorption intensity were determined on 200 grains.

The adsorption amount of dye was measured as follows. The obtained liquid emulsion was centrifuged at 10,000 rpm for 10 minutes and thereby precipitated. The precipitate was freeze-dried and to 0.05 g of the precipitate, 25 ml of an aqueous 25% sodium thiosulfate solution and methanol were added to make 50 ml. The resulting solution was analyzed by high-performance liquid chromatography and the dye concentration was quantitated to determine the adsorption amount of dye. From the adsorption amount of dye determined as such and the single layer saturated coverage, the adsorption layer number of dye was obtained.

(3) Preparation of Coated Sample

An emulsion layer and a protective layer shown in Table 1 were coated on a triacetyl cellulose film support having provided thereon an undercoat layer. Also, Samples 101 to 122 were manufactured by changing Comparative Compound S-1 to an equimolar amount of the compound of the present invention.

TABLE 1

| Emulsion Coating Conditions | |
|---|---|
| (1) Emulsion Layer | |
| Emulsion: Emulsion b (dye used is shown in Table 2) | |
| Coupler: | ($1.6 \times 10^{-3}$ mol/m$^2$) |

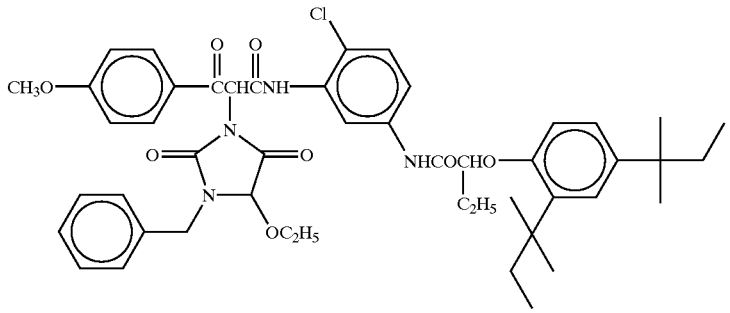

| | |
|---|---|
| Tricresyl phosphate | (1.10 g/m$^2$) |
| Gelatin | (2.30 g/m$^2$) |
| (2) Protective Layer | |
| 2,4-Dichloro-6-hydzoxy-s-triazine sodium salt | (0.08 g/m$^2$) |
| Gelatin | (1.80 g/m$^2$) |

These samples each was subjected to exposure for sensitometry (1/100 seconds) and then to the following color development.

Processing Method:

| Step | Processing Time | Processing Temperature (° C.) | Replenishing Amount (ml) | Tank Volume (liter) |
|---|---|---|---|---|
| Color development | 2 min 45 sec | 38 | 33 | 20 |
| Bleaching | 6 min 30 sec | 38 | 25 | 40 |
| Water washing | 2 min 10 sec | 24 | 1,200 | 20 |
| Fixing | 4 min 20 sec | 38 | 25 | 30 |
| Water washing 1 | 1 min 05 sec | 24 | counter-current piping system from (2) to (1) | 10 |
| Waster washing 2 | 1 min 00 sec | 24 | 1,200 | 10 |
| Stabilization | 1 min 05 sec | 38 | 25 | 10 |
| Drying | 4 min 20 sec | 55 | | |

The replenishing amount was per 1-m length in 35-mm width.

The composition of each processing solution is shown below.

| | Mother Solution (g) | Replenisher (g) |
|---|---|---|
| (Color Developer) | | |
| Diethylenetriaminepentaacetic acid | 1.0 | 1.1 |
| 1-Hydroxyethylidene-1,1-diphosphonic acid | 3.0 | 3.2 |
| Sodium sulfite | 4.0 | 4.4 |

-continued

| | Mother Solution (g) | Replenisher (g) |
|---|---|---|
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |
| 4-[N-Ethyl-N-β-hydroxyethyl-amino]-2-methylaniline sulfate | 4.5 | 5.5 |
| Water to make | 1.0 liter | 1.0 liter |
| PH | 10.05 | 10.05 |
| (Bleaching Solution) | | |
| Sodium ethylenediamine-tetraacetato ferrate trihydrate | 100.0 | 120.0 |
| Disodium ethylenediamine-tetraacetate | 10.0 | 11.0 |
| Ammonium bromide | 140.0 | 160.0 |
| Ammonium nitrate | 30.0 | 35.0 |
| Aqueous ammonia (27%) | 6.5 ml | 4.0 ml |
| Water to make | 1.0 liter | 1.0 liter |
| PH | 6.0 | 5.7 |
| (Fixing Solution) | | |
| Sodium ethlenediaminetetraacetate | 0.5 | 0.7 |
| Sodium sulfite | 7.0 | 8.0 |
| Sodium bisulfite | 5.0 | 5.5 |
| Aqueous ammonium thiosulfate (70%) | 170.0 ml | 200.0 ml |
| Water to make | 1.0 liter | 1.0 liter |
| PH | 6.7 | 6.65 |
| (Stabilizing Solution) | | |
| Formalin | 2.0 ml | 3.0 ml |
| Polyoxyethylene-p-monononylphenyl ether (average polymerization degree: 10) | 0.3 | 0.45 |

-continued

| | Mother Solution (g) | Replenisher (g) |
|---|---|---|
| Disodium ethylenediamine-tetraacetate | 0.05 | 0.08 |
| Water to make | 1.0 liter | 1.0 liter |
| PH | 5.8–8.0 | 5.8–8.0 |

Each processed sample was measured on the density through a blur filter and evaluated on the sensitivity and fog.

The sensitivity is defined as a reciprocal of the exposure amount of giving a density 0.2 higher than the fog density, and the sensitivity of each sample is shown by a relative value to Sample 101 of which sensitivity was taken as 100. The emulsions used in each Sample, the light absorption intensity of each compound used in Examples and Comparative Example, and the sensitivity of each Sample are shown in Table 2. The light absorption intensity is an average value of 200 grains, which was obtained by microspectrophotometry. The light absorption intensity and the sensitivity both are based on Comparative Example 101. Incidentally, the light absorption of Comparative Example 101 was 58.

TABLE 2

| Sample No. | Compound | Light Absorption Intensity | Sensitivity | Remarks |
|---|---|---|---|---|
| 101 | S-1 | 1 (control) | 100 (control) | Comparison |
| 102 | D-1 | 1.73 | 158 | Invention |
| 103 | D-5 | 1.83 | 168 | Invention |
| 104 | D-9 | 1.85 | 170 | Invention |
| 105 | D-14 | 1.80 | 166 | Invention |
| 106 | D-15 | 1.82 | 167 | Invention |
| 107 | D-17 | 1.80 | 165 | Invention |
| 108 | D-18 | 1.82 | 167 | Invention |
| 109 | D-19 | 1.78 | 164 | Invention |
| 110 | D-21 | 1.75 | 162 | Invention |
| 111 | D-23 | 1.74 | 161 | Invention |
| 112 | D-30 | 1.69 | 156 | Invention |
| 113 | D-32 | 1.70 | 155 | Invention |
| 114 | D-34 | 1.81 | 166 | Invention |
| 115 | D-35 | 1.78 | 164 | Invention |
| 116 | D-36 | 1.83 | 168 | Invention |
| 117 | D-37 | 1.80 | 165 | Invention |
| 118 | D-38 | 1.69 | 157 | Invention |
| 119 | D-39 | 1.82 | 167 | Invention |
| 120 | D-40 | 1.79 | 163 | Invention |
| 121 | D-41 | 1.76 | 162 | Invention |
| 122 | D-42 | 1.80 | 165 | Invention |
| 123 | D-43 | 1.78 | 163 | Invention |
| 124 | D-44 | 1.79 | 164 | Invention |
| 125 | D-57 | 1.83 | 169 | Invention |
| 126 | D-58 | 1.80 | 166 | Invention |
| 127 | D-59 | 1.84 | 172 | Invention |
| 128 | D-61 | 1.87 | 174 | Invention |
| 129 | D-66 | 1.83 | 171 | Invention |
| 130 | D-68 | 1.86 | 173 | Invention |
| 131 | D-70 | 1.84 | 172 | Invention |
| 132 | D-73 | 1.82 | 171 | Invention |
| 133 | D-75 | 1.83 | 174 | Invention |
| 134 | D-77 | 1.84 | 168 | Invention |
| 135 | D-79 | 1.81 | 167 | Invention |
| 136 | D-85 | 1.85 | 172 | Invention |
| 137 | D-86 | 1.87 | 175 | Invention |
| 138 | D-87 | 1.86 | 173 | Invention |
| 139 | D-88 | 1.84 | 175 | Invention |
| 140 | D-91 | 1.85 | 169 | Invention |

S-1

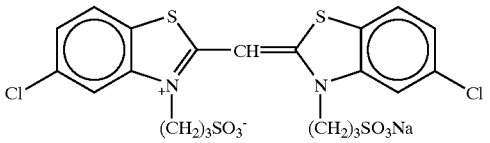

C-5

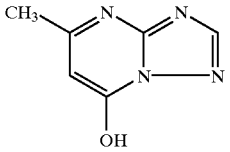

It is apparent from Table 2 that as compared with Comparative Compound S-1, the compound of the present invention has an effect of improving the absorptivity by virtue of the multiple structure formed by the compound, as a result, the sensitivity is elevated. Furthermore, this effect is higher in the compound where a linking group is connected to the acidic nucleus of the merocyanine dye, and is still higher in the compound where a dissociative group is connected through a 1,2-phenylene group.

In Sample 104 using Compound D-9 of the present invention, the adsorption layer number is 1.94 and this reveals that nearly a two-layer structure is formed.

From these results, it is verified that the photo-excited second layer dye contributes to the attainment of high sensitivity by way of energy transfer or electron transfer to the first layer dye.

Example 3

The same comparison as in Example 2 was performed using the color negative light-sensitive system described in Example 5 of JP-A-8-29904. As a result, assuming that the sensitivity of the blue-sensitive layer of the light-sensitive material in Comparative Example using S-1 was 100 (control), the light-sensitive materials using D-9 and D-86 of the present invention exhibited high sensitivity of 168 and 171, respectively. Also, the same comparison was performed using the instant light-sensitive system described in Example 1 of JP-A-2000-284442, as a result, assuming that the sensitivity of the blue-sensitive layer of the light-sensitive material in Comparative Example using S-1 was 100 (control), the light-sensitive materials using D-9 and D-86 of the present invention exhibited high sensitivity of 165 and 167, respectively. Furthermore, in the color reversal light-sensitive system described in Example 1 of JP-A-7-92601 and JP-A-11-160828, the color paper system described in Example 1 of JP-A-6-347944, the X-ray light-sensitive material described in Example 1 of JP-A-8-122954, the photothermographic (light-sensitive) material system described in Example 1 of JP-A-2001-281785, and the printing light-sensitive material system described in Example 1 of JP-A-8-292512, the light-sensitive material using the compound of the present invention was also found to exhibit high sensitivity as compared with those using the comparative compound. In addition, in any of these systems, high light absorption intensity and a large adsorption layer number of chromophore were attained, revealing that the present invention is useful also in these systems.

By using the methine dye connection compound of the present invention, a multilayer structure is formed and therefore, the light absorptivity is improved, as a result, a high-speed silver halide photographic light-speed material can be obtained.

The entitle disclosure of each and every foreign patent application from which the benefit of foreign priority has been claimed in the present application is incorporated herein by reference, as if fully set forth herein.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising a support having thereon at least one light-sensitive silver halide emulsion layer, wherein said emulsion layer contains a compound represented by the following formula (1):

$$\text{Dye1-(L}_1\text{-(Dye2)m1)m2} \quad (1)$$

wherein Dye1 represents a cyanine chromophore, Dye2 represents a merocyanine dye having in the acid nucleus thereof at least one dissociative group having a pKa of 5 or less, and $L_1$ represents a linking group connected to the acidic nucleus of the merocyanine dye Dye2 and is resented by $-G_1-(A_1-G_2)_{t1}-$ (wherein $G_1$ and $G_2$ each independently represents an alkylene, alkenylene or arylene group which may be substituted, $A_1$ represents, irrespective of the direction, —O—, —S—, $—SO_2—$, $—NR_3—$, —COO—, $—CONR_4—$ or $—SO_2NR_5—$ (wherein $R_3$ to $R_5$ each independently represents a hydrogen atom, an alkyl group, an alkenyl group, an aryl group or a heterocyclic group) and t1 represents an integer of 1 to 10), m1 represents an integer of 1 to 5, and m2 represents an integer of 1 to 5.

2. The silver halide photographic light-sensitive material as claimed in claim 1, wherein the compound represented by formula (1) is represented by the following formula (2):

(Dye2)

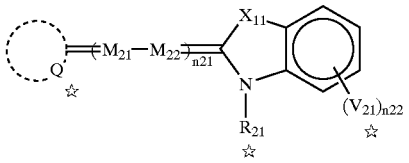

(2)

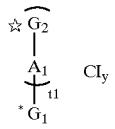

(Dye1)

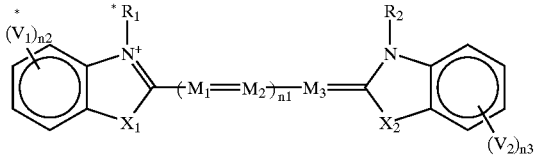

wherein $G_1$, $G_2$, $A_1$ and t1 have the same meanings as defined in claim 1; $X_1$, $X_2$ and $X_{11}$ each independently represents —O—, —S—, $—NR_6$ or $—CR_7R_8—$; $R_6$ to $R_8$ each independently represents a hydrogen atom, an alkyl group, an alkenyl group, an aryl group or a heterocyclic group; $R_1$, $R_2$ and $R_{21}$ each independently represents a hydrogen atom, an alkyl group, an alkenyl group, an aryl group or a heterocyclic group; $M_1$ to $M_3$, $M_{21}$ and $M_{22}$ each independently represents a methine group; n1 and n21 each independently represents an integer of 0 to 3; $V_1$, $V_2$ and $V_{21}$ each represents a substituent; n2, n3 and n22 each represents an integer of 0 to 4, provided that when n2, n3 and n22 each is 2 or more, the substituents $V_1$, the substituents $V_2$ or the substituents $V_{21}$ may be the same or different or may be combined with each other to form a ring; CI represents an ion for neutralizing the electric charge; y represents a number necessary for neutralizing the electric charge; the ring formed by Q is represented by the following formula (3-1), (3-2), (3-3) or (3-4):

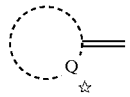

(3-1)

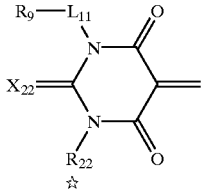

(3-2)

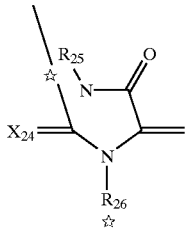

(3-3)

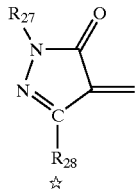

(3-4)

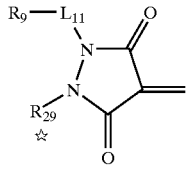

wherein $R_{22}$ and $R_{29}$ each independently represents a hydrogen atom, an alkyl group, an alkenyl group, an aryl group or a heterocyclic group, $R_{25}$ to $R_{27}$ each independently represents a hydrogen atom, an alkyl group, an alkenyl group, an aryl group, a heterocyclic group or $R_9$-$L_{11}$- , $R_{28}$ represents a substituent, a hydrogen atom or $R_9$-$L_{11}$- (wherein $R_9$ represents a dissociative group having a pKa of 5 or less, and $L_{11}$ represents a linking group), provided that either one of $R_{25}$ and $R_{26}$ is $R_9$-$L_{11}$- and either one of $R_{27}$ and $R_{28}$ is $R_9$-$L_{11}$- , and $X_{22}$ and $X_{24}$ each independently represents an oxygen atom or a sulfur atom; and $G_1$ is connected to Dye1 through $R_1$ or $V_1$ and $G_2$ is connected to Dye2 through $R_{21}$, $R_{22}$, $R_{25}$, $R_{26}$, $R_{27}$, $R_{28}$, $R_{29}$ or $V_{21}$.

3. The silver halide photographic light-sensitive material as claimed in claim 1, wherein the dissociative group in the compound represented by formula (1) is —$SO_3M$, —$OSO_3M_2$, —$PO_3M_2$, —$OPO_3M_2$ or —COOM, and M is proton or cation.

4. The silver halide photographic light-sensitive material as claimed in claim 1, wherein in the compound represented by formula (1), the adsorption strength to silver halide grain is Dye1>Dye2.

5. The silver halide photographic light-sensitive material as claimed in claim 1, wherein in the compound represented by formula (1), $A_1$ is —O—, —$O_2$—, —COO— or —$CONR_4$—.

6. The silver halide photographic light-sensitive material as claimed in claim 2, wherein in the compound represented by formula (2), n1 is 0, $X_1$ and $X_2$ each is —S—, and n21 is 1.

7. The silver halide photographic light-sensitive material as claimed in claim 2, wherein in the compound represented by formula (2), $X_{21}$ is —O—.

8. The silver halide photographic light-sensitive material as claimed in claim 3, wherein the dissociative group in the compound represented by formula (1) or $R_9$ in the compound represented by formula (2) is —$SO_3M$.

9. The silver halide photographic light-sensitive material as claimed in claim 2, wherein in the compound represented by formula (2), $L_{11}$ is an alkylene group which may be substituted or a phenylene group which may be substituted.

10. The silver halide photographic light-sensitive material as claimed in claim 9, wherein in the compound represented by formula (2), $L_{11}$ is an ethylene group.

11. The silver halide photographic light-sensitive material as claimed in claim 9, wherein in the compound represented by formula (2), $L_{11}$ is a phenylene group which may be substituted.

12. The silver halide photographic light-sensitive material as claimed in claim 9, wherein in the compound represented by formula (2), $L_{11}$ is a 1,2-phenylene group which may be substituted.

13. The silver halide photographic light-sensitive material as claimed in claim 2, wherein in the compound represented by formula (2), $G_1$ is connected with $R_1$ and $G_2$ is connected with $R_{22}$, $R_{25}$, $R_{26}$, $R_{27}$, $R_{28}$ or $R_{29}$.

14. The silver halide photographic light-sensitive material as claimed in claim 2, wherein in the compound represented by formula (2), Q is represented by formula (3-1), a silver halide grain through Dye1 and forms a J-aggregate.

15. The silver halide photographic light-sensitive material as claimed in claim 1, wherein the silver halide photographic emulsion containing the compound represented by formula (1) is an emulsion in which tabular grains having an aspect ratio of 2 or more are present in a proportion of 50% (by area) or more of all silver halide grains in the emulsion.

16. The silver halide photographic light-sensitive material as claimed in claim 1, wherein the silver halide photographic emulsion containing the compound represented by formula (1) is subjected to selenium sensitization.

* * * * *